US007944330B2

(12) United States Patent
Yamao et al.

(10) Patent No.: US 7,944,330 B2
(45) Date of Patent: May 17, 2011

(54) RESONANT ELEMENT AND HIGH FREQUENCY FILTER, AND WIRELESS COMMUNICATION APPARATUS EQUIPPED WITH THE RESONANT ELEMENT OR THE HIGH FREQUENCY FILTER

(75) Inventors: Yasushi Yamao, Chofu (JP); Makoto Hasegawa, Daito (JP); Hiroyuki Kobayashi, Daito (JP)

(73) Assignees: Funai Electric Co., Ltd., Daito-shi (JP); The University of Electro-Communications, Chofu-shi (JP)

( * ) Notice: Subject to any disclaimer, the term of this patent is extended or adjusted under 35 U.S.C. 154(b) by 315 days.

(21) Appl. No.: 12/043,585

(22) Filed: Mar. 6, 2008

(65) Prior Publication Data

US 2009/0224855 A1 Sep. 10, 2009

(51) Int. Cl.
*H01P 1/203* (2006.01)
*H01P 3/08* (2006.01)

(52) U.S. Cl. ..... 333/202; 333/33; 333/204; 333/236

(58) Field of Classification Search ..... 333/33, 333/204, 205, 219, 236, 262, 258, 202
See application file for complete search history.

(56) References Cited

U.S. PATENT DOCUMENTS

| | | | | |
|---|---|---|---|---|
| 5,808,527 | A * | 9/1998 | De Los Santos | 333/205 |
| 6,043,727 | A * | 3/2000 | Warneke et al. | 333/205 |
| 7,292,124 | B2 * | 11/2007 | Kawai et al. | 333/219 |
| 7,573,356 | B2 * | 8/2009 | Kawai et al. | 333/205 |
| 7,583,168 | B2 * | 9/2009 | Kawai et al. | 333/238 |
| 2004/0104785 | A1 * | 6/2004 | Park et al. | 333/33 |

FOREIGN PATENT DOCUMENTS

| | | | |
|---|---|---|---|
| EP | 1783854 | A1 * | 5/2007 |
| JP | 8-242118 | | 9/1996 |
| JP | 11-243304 | A | 9/1999 |
| JP | 2003-23383 | | 1/2003 |
| JP | 2006-86630 | | 3/2006 |
| JP | 2006-325163 | | 11/2006 |

* cited by examiner

*Primary Examiner* — Robert Pascal
*Assistant Examiner* — Kimberly E Glenn
(74) *Attorney, Agent, or Firm* — Crowell & Moring LLP

(57) ABSTRACT

A resonant element that causes a signal input from an input terminal to resonate at a predetermined resonance frequency and outputs it to an output terminal is provided. The element has a transmission line series including a plurality of transmission lines connected in series with each other and intersecting with a hotline connecting the input terminal and the output terminal and a plurality of switches. At least one of one end and the other end of the transmission line series is a grounded end. The resonant element having first and second end side, each end side having a first transmission line and a second transmission line connected to a switch having a grounded end. The resonance frequency is switched by turning on/off the switch to change the sum of the lengths of the transmission lines through which the signal passes.

10 Claims, 21 Drawing Sheets

FIG. 5

| | STATUS OF SWITCH | | RESONANCE LENGTH OF TRANSMISSION LINE |
|---|---|---|---|
| | SWITCH 9a1 | SWITCH 9b1 | |
| 1 | ON | ON | Lb1+Lc1 (= λ/2 AT RESONANCE FREQUENCY) |
| 2 | ON | OFF | Lb1+Lc1+Ld1 (= λ/2 AT RESONANCE FREQUENCY) |
| 3 | OFF | ON | La1+Lb1+Lc1 (= λ/2 AT RESONANCE FREQUENCY) |
| 4 | OFF | OFF | La1+Lb1+Lc1+Ld1 (= λ/2 AT RESONANCE FREQUENCY) |

FIG.8

| | STATUS OF SWITCH | | RESONANCE LENGTH OF TRANSMISSION LINE |
|---|---|---|---|
| | SWITCH 9a2 | SWITCH 9b2 | |
| 1 | ON | ON | Lb2+Lc2(= λ/2 AT RESONANCE FREQUENCY) |
| 2 | ON | OFF | Lb2+Lc2+Ld2(= λ/4 AT RESONANCE FREQUENCY) |
| 3 | OFF | ON | La2+Lb2+Lc2(= λ/2 AT RESONANCE FREQUENCY) |
| 4 | OFF | OFF | La2+Lb2+Lc2+Ld2(= λ/4 AT RESONANCE FREQUENCY) |

FIG.11

| | STATUS OF SWITCH | | | | RESONANCE LENGTH OF TRANSMISSION LINE |
|---|---|---|---|---|---|
| | SWITCH 9a3 | SWITCH 9b3 | SWITCH 9c3 | SWITCH 9d3 | |
| 1 | ON | ON | ON | ON | Lc3+Ld3(= λ/2 AT RESONANCE FREQUENCY) |
| 2 | OFF | ON | ON | ON | La3+Lc3+Ld3(= λ/2 AT RESONANCE FREQUENCY) |
| 3 | ON | OFF | ON | ON | Lb3+Lc3+Ld3(= λ/2 AT RESONANCE FREQUENCY) |
| 4 | ON | ON | OFF | ON | Lc3+Ld3+Le3(= λ/2 AT RESONANCE FREQUENCY) |
| 5 | ON | ON | ON | OFF | Lc3+Ld3+Lf3(= λ/2 AT RESONANCE FREQUENCY) |
| 6 | OFF | OFF | ON | ON | La3+Lb3+Lc3+Ld3(= λ/2 AT RESONANCE FREQUENCY) |
| 7 | OFF | ON | OFF | ON | La3+Lc3+Ld3+Le3(= λ/2 AT RESONANCE FREQUENCY) |
| 8 | OFF | ON | ON | OFF | La3+Lc3+Ld3+Lf3(= λ/2 AT RESONANCE FREQUENCY) |
| 9 | ON | OFF | OFF | ON | Lb3+Lc3+Ld3+Le3(= λ/2 AT RESONANCE FREQUENCY) |
| 10 | ON | OFF | ON | OFF | Lb3+Lc3+Ld3+Lf3(= λ/2 AT RESONANCE FREQUENCY) |
| 11 | ON | ON | OFF | OFF | Lc3+Ld3+Le3+Lf3(= λ/2 AT RESONANCE FREQUENCY) |
| 12 | OFF | OFF | OFF | ON | La3+Lb3+Lc3+Ld3+Le3(= λ/2 AT RESONANCE FREQUENCY) |
| 13 | OFF | OFF | ON | OFF | La3+Lb3+Lc3+Ld3+Lf3(= λ/2 AT RESONANCE FREQUENCY) |
| 14 | OFF | ON | OFF | OFF | La3+Lc3+Ld3+Le3+Lf3(= λ/2 AT RESONANCE FREQUENCY) |
| 15 | ON | OFF | OFF | OFF | Lb3+Lc3+Ld3+Le3+Lf3(= λ/2 AT RESONANCE FREQUENCY) |
| 16 | OFF | OFF | OFF | OFF | La3+Lb3+Lc3+Ld3+Le3+Lf3(= λ/2 AT RESONANCE FREQUENCY) |

FIG.14

| | STATUS OF SWITCH | | | | RESONANCE LENGTH OF TRANSMISSION LINE |
|---|---|---|---|---|---|
| | SWITCH 9a4 | SWITCH 9b4 | SWITCH 9c4 | SWITCH 9d4 | |
| 1 | ON | ON | ON | ON | Lc4+Ld4(= λ/2 AT RESONANCE FREQUENCY) |
| 2 | OFF | ON | ON | ON | La4+Lc4+Ld4(= λ/2 AT RESONANCE FREQUENCY) |
| 3 | ON | OFF | ON | ON | Lb4+Lc4+Ld4(= λ/2 AT RESONANCE FREQUENCY) |
| 4 | ON | ON | OFF | ON | Lc4+Ld4+Le4(= λ/2 AT RESONANCE FREQUENCY) |
| 5 | ON | ON | ON | OFF | Lc4+Ld4+Lf4(= λ/4 AT RESONANCE FREQUENCY) |
| 6 | OFF | OFF | ON | ON | La4+Lb4+Lc4+Ld4(= λ/2 AT RESONANCE FREQUENCY) |
| 7 | OFF | ON | OFF | ON | La4+Lc4+Ld4+Le4(= λ/2 AT RESONANCE FREQUENCY) |
| 8 | OFF | ON | ON | OFF | La4+Lc4+Ld4+Lf4(= λ/4 AT RESONANCE FREQUENCY) |
| 9 | ON | OFF | OFF | ON | Lb4+Lc4+Ld4+Le4(= λ/2 AT RESONANCE FREQUENCY) |
| 10 | ON | OFF | ON | OFF | Lb4+Lc4+Ld4+Lf4(= λ/4 AT RESONANCE FREQUENCY) |
| 11 | ON | ON | OFF | OFF | Lc4+Ld4+Le4+Lf4(= λ/4 AT RESONANCE FREQUENCY) |
| 12 | OFF | OFF | OFF | ON | La4+Lb4+Lc4+Ld4+Le4(= λ/2 AT RESONANCE FREQUENCY) |
| 14 | OFF | OFF | ON | OFF | La4+Lb4+Lc4+Ld4+Lf4(= λ/4 AT RESONANCE FREQUENCY) |
| 14 | OFF | ON | OFF | OFF | La4+Lc4+Ld4+Le4+Lf4(= λ/4 AT RESONANCE FREQUENCY) |
| 15 | ON | OFF | OFF | OFF | Lb4+Lc4+Ld4+Le4+Lf4(= λ/4 AT RESONANCE FREQUENCY) |
| 16 | OFF | OFF | OFF | OFF | La4+Lb4+Lc4+Ld4+Le4+Lf4(= λ/4 AT RESONANCE FREQUENCY) |

FIG.17

| | STATUS OF SWITCH | | | | RESONANCE LENGTH OF TRANSMISSION LINE |
|---|---|---|---|---|---|
| | SWITCH 9a5 | SWITCH 9b5 | SWITCH 9c5 | SWITCH 9d5 | |
| 1 | ON | ON | ON | ON | Lc5+Ld5(=λ/4 AT RESONANCE FREQUENCY) |
| 2 | OFF | ON | ON | ON | La5+Lc5+Ld5(=λ/4 AT RESONANCE FREQUENCY) |
| 5 | ON | OFF | ON | ON | Lb5+Lc5+Ld5(=λ/4 AT RESONANCE FREQUENCY) |
| 5 | ON | ON | OFF | ON | Lc5+Ld5+Le5(=λ/4 AT RESONANCE FREQUENCY) |
| 5 | ON | ON | ON | OFF | Lc5+Ld5+Lf5(=λ/4 AT RESONANCE FREQUENCY) |
| 6 | OFF | OFF | ON | ON | La5+Lb5+Lc5+Ld5(=λ/4 AT RESONANCE FREQUENCY) |
| 7 | OFF | ON | OFF | ON | La5+Lc5+Ld5+Le5(=λ/4 AT RESONANCE FREQUENCY) |
| 8 | OFF | ON | ON | OFF | La5+Lc5+Ld5+Lf5(=λ/4 AT RESONANCE FREQUENCY) |
| 9 | ON | OFF | OFF | ON | Lb5+Lc5+Ld5+Le5(=λ/4 AT RESONANCE FREQUENCY) |
| 10 | ON | OFF | ON | OFF | Lb5+Lc5+Ld5+Lf5(=λ/4 AT RESONANCE FREQUENCY) |
| 11 | ON | ON | OFF | OFF | Lc5+Ld5+Le5+Lf5(=λ/4 AT RESONANCE FREQUENCY) |
| 12 | OFF | OFF | OFF | ON | La5+Lb5+Lc5+Ld5+Le5(=λ/4 AT RESONANCE FREQUENCY) |
| 15 | OFF | OFF | ON | OFF | La5+Lb5+Lc5+Ld5+Lf5(=λ/4 AT RESONANCE FREQUENCY) |
| 15 | OFF | ON | OFF | OFF | La5+Lc5+Ld5+Le5+Lf5(=λ/4 AT RESONANCE FREQUENCY) |
| 15 | ON | OFF | OFF | OFF | Lb5+Lc5+Ld5+Le5+Lf5(=λ/4 AT RESONANCE FREQUENCY) |
| 16 | OFF | OFF | OFF | OFF | La5+Lb5+Lc5+Ld5+Le5+Lf5(=λ/4 AT RESONANCE FREQUENCY) |

RESONANT ELEMENT AND HIGH FREQUENCY FILTER, AND WIRELESS COMMUNICATION APPARATUS EQUIPPED WITH THE RESONANT ELEMENT OR THE HIGH FREQUENCY FILTER

BACKGROUND OF THE INVENTION

1. Field of the Invention

The present invention relates a resonant element and a high frequency filter, and a wireless communication apparatus equipped with such a resonant element or high frequency filter.

2. Description of Related Art

Conventionally, wireless communication apparatuses that can transmit and receive wireless communication signals have been known. The radio frequency used in the wireless communication apparatus varies depending on the generation of the mobile communication system and on the region (e.g. country). For example, when it is desired to use both the second and third generation mobile communication systems through one wireless communication apparatus, or when it is desired to use a wireless communication apparatus in a plurality of regions, it is necessary to prepare a plurality of frequency bands that can be set and to switch to a desired frequency band to be used.

Therefore, in conventional wireless communication apparatuses, for example, a resonant element or a high frequency filter that has been tuned to a single frequency is prepared and provided for each of the frequency bands that are desired to be set, and the resonant element or the high frequency filter to be used is to be selected by a switch.

For example, there has been developed an antenna sharing device for allowing a transmitter and a receiver to share a single antenna. In order to achieve high attenuation and low loss without increasing the size of the antenna sharing device, the antenna sharing device is provided with five resonators, five capacitors and five switches etc, and the transmission band and the reception band can be switched in synchronized manner by turning on/off the switches. Specifically, there has been developed an antenna sharing device in which low bands (transmission low band and reception low band) and high bands (transmission high band and reception high band) can be switched over by turning on/off the switches (see, for example, Japanese Patent Application Laid-Open No. 11-243304).

As a further example, there has been developed a wide band transmission/reception apparatus. In order to enable an amplifier to perform amplification over a wide band by adjusting the resonance frequencies of resonance circuits, the apparatus is provided with two resonance circuits (each having an inductor and a capacitor connected in parallel with the inductor and further having four capacitors and four switches to switch over the parallel capacitances etc.) that enable switching between sixteen resonance frequencies by controlling switching of the switches by a 4-bit control signal, one of the resonance circuits being connected to the input of the amplifier and the other resonance circuit being connected to the output of the amplifier, wherein a desired frequency can be extracted from among frequencies of the signal to be received or transmitted by means of one resonance circuit, and the resonance frequency can be adjusted in accordance with the frequency of the signal to be received or transmitted by means of the other resonance circuit (see, for example, Japanese Patent Application Laid-Open No. 2006-325163).

As a still further example, there has been developed an antenna device or the like to be used in a portable terminal. In order to enable switching between frequencies over a wide band, the antenna device is provided with two separated antenna elements having first and second resonance frequencies, two power supply units that supply power to the two separated antenna elements respectively, and four switches, and switching between six resonance frequencies can be achieved by turning on/off the switches (see, for example, Japanese Patent Application Laid-Open No. 2006-086630).

As a still further example, there has been developed a flat antenna in which in order to enable transmission and reception of communication signals over a wide band with a single, small-size flat antenna, a plurality of slit-like cuts are formed on a radiating conductor and four switches each having contacts on the radiating conductors in such a way as to bridge each cut are provided, wherein switching between sixteen resonance frequencies is achieved by turning on/off the switches (see, for example, Japanese Patent Application Laid-Open No. 08-242118).

As a still further example, there has been developed a roadside antenna apparatus used in an ETC (Electronic Toll Collection) system or the like in which in order to adjust the phase of signals to be transmitted and received, a phase changing circuit is provided with three transmission paths for changing the phase values and six switches, wherein switching between eight phase values can be achieved by turning on/off the switches (see, for example, Japanese Patent Application Laid-Open No. 2003-023383).

In the conventional wireless communication apparatuses, however, an increase in the number of frequency bands desired to be set necessitates an increase in the number of resonant elements or high frequency filters and an increase in the number of switches too. Thus, the problem of cost incurred by the increase in the size of the circuit and an increase in the number of parts will be encountered.

In addition, an increase in the number of switches also leads to a problem of an increase in the signal loss.

In the case of the configuration disclosed in Japanese Patent Application Laid-Open No. 11-243304, it is necessary to provide capacitors etc. in addition to resonators and switches. In addition, the resonance frequency cannot be switched between more than two frequencies (two modes) though as much as five switches are used.

In the case of the configuration disclosed in Japanese Patent Application Laid-Open No. 2006-325163, it is necessary to provide two resonance circuits each having an inductor, a capacitor connected in parallel with the inductor, additional four capacitors and four switches to switch the parallel capacitances. In addition, the resonance frequency cannot be switched between more than sixteen frequencies though eight switches in total are provided for signals to be received (or signals to be transmitted).

Thus, neither Japanese Patent Application Laid-Open No. 11-243304 nor Japanese Patent Application Laid-Open No. 2006-325163 can give a solution to the problem of cost incurred by an increase in the size of the circuit and an increase in the number of parts encountered with an increase in the number of frequency bands desired to be set or a solution to the problem of increase in the signal loss caused by an increase in the number of switches.

Japanese Patent Application Laid-Open No. 2006-086630 and Japanese Patent Application Laid-Open No. 08-242118 pertain to switching of the resonance frequency of the antenna, where an antenna element or a radiating conductor is essential. Therefore, switching of the resonance frequency of a resonant element or a high frequency filter that does not have an antenna element or a radiating conductor cannot be achieved.

Although Japanese Patent Application Laid-Open No. 2003-023383 discloses a simple configuration including transmission paths and switches, it teaches switching of the phase value instead of switching of the resonance frequency. In addition, the phase value cannot be switched between more than eight values though as much as six switches are used.

SUMMARY OF THE INVENTION

It is an object of the present invention to provide a resonant element in which switching between a plurality of resonance frequencies can be achieved by a simple configuration with low signal loss, a high frequency filter in which switching between a plurality of passbands or stopbands can be achieved by a simple configuration with low signal loss, and a wireless communication apparatus equipped with such a resonant element or such a high frequency filter.

To achieve the above object, according to a first aspect of the present invention, there is provided a resonant element that causes a signal input from an input terminal to resonate at a predetermined resonance frequency and outputs it to an output terminal, comprising:

a transmission line series that includes a plurality of transmission lines connected in series with each other and intersects with a hotline that connects the input terminal and the output terminal; and a plurality of switches, wherein at least one of one end and the other end of the transmission line series is a grounded end, the transmission lines are categorized into a first transmission line, which is a transmission line having a fixed length, and a second transmission line, which is a transmission line to which the switch one end of which is a grounded end is connected in series at a point between it and an adjacent transmission line, the transmission line in one end side of the transmission line series in a first section extending from the intersection point of the transmission line series and the hotline to one end of the transmission line series and the transmission line in the other end side of the transmission line series in a second section extending from the intersection point to the other end of the transmission line series are the second transmission lines, the first transmission line is provided in the first section and the second section, and the resonance frequency is switched by turning on/off the switch to change the sum of the lengths of the transmission lines through which the signal passes.

According to a second aspect of the present invention, there is provided a resonant element that causes a signal input from an input terminal to resonate at a predetermined resonance frequency and outputs it to an output terminal, comprising:

a transmission line series that includes a plurality of transmission lines connected in series with each other and intersects with a hotline that connects the input terminal and the output terminal; and a plurality of switches, wherein at least one of one end and the other end of the transmission line series is a grounded end, the transmission lines are categorized into a first transmission line, which is a transmission line having a fixed length, a second transmission line, which is a transmission line to which the switch one end of which is a grounded end is connected in series at a point between it and an adjacent transmission line, and a third transmission line, which is a transmission line to which the switch is connected in parallel, the transmission line in one end side of the transmission line series in a first section extending from the intersection point of the transmission line series and the hotline to one end of the transmission line series and the transmission line in the other end side of the transmission line series in a second section extending from the intersection point to the other end of the transmission line series are the second transmission lines, the third transmission line is provided in at least one of the first section and the second section, the first transmission line is provided in the first section and the second section, and the resonance frequency is switched by turning on/off the switch to change the sum of the lengths of the transmission lines through which the signal passes.

According to a third aspect of the present invention, there is provided a resonant element that causes a signal input from an input terminal to resonate at a predetermined resonance frequency and outputs it to an output terminal, comprising:

a transmission line series that includes a plurality of transmission lines connected in series with each other and intersects with a hotline that connects the input terminal and the output terminal; and a plurality of switches, wherein one end of the transmission line series is a grounded end and the other end is an open end, the transmission lines are categorized into a first transmission line, which is a transmission line having a fixed length, a second transmission line, which is a transmission line to which the switch one end of which is a grounded end is connected in series at a point between it and an adjacent transmission line, and a third transmission line, which is a transmission line to which the switch is connected in parallel, the transmission line in one end side of the transmission line series in a first section extending from the intersection point of the transmission line series and the hotline to one end of the transmission line is the second transmission line, the third transmission line is provided in at least one of the first section and a second section extending from the intersection point to the other end of the transmission line series, the first transmission line is provided in at least the first section among the first section and the second section, and the resonance frequency is switched by turning on/off the switch to change the sum of the lengths of the transmission lines through which the signal passes.

In the resonant element according to the first to third aspects of the present invention, it is preferred that the switches be MEMS (Micro Electro Mechanical Systems) switches.

According to a fourth aspect of the present invention, there is provided a high frequency filter comprising a plurality of resonant elements according to any one of the first to third aspects of the present invention.

In the fourth aspect of the present invention, all the stages of the resonant elements may be designed to have bandpass characteristics, or one or some of the stages may be designed to have bandstop characteristics.

According to a fifth aspect of the present invention, there is provided a wireless communication apparatus equipped with a resonant element according to any one of the first to third aspects of the present invention or a high frequency filter according to fourth aspect of the present invention.

BRIEF DESCRIPTION OF THE DRAWINGS

The above-described and other objects, advantages and features of present invention will become more fully understood from the detailed description given hereinbelow and the appended drawings, which are not intended to limit the present invention though, wherein:

FIG. 5 is a second presentation for explaining switching of the resonance frequency of the resonant element according to the first embodiment;

FIG. 8 is a second presentation for explaining switching of the resonance frequency of the resonant element according to the second embodiment;

FIG. 11 is a second presentation for explaining switching of the resonance frequency of the resonant element according to the third embodiment;

FIG. 14 is a second presentation for explaining switching of the resonance frequency of the resonant element according to the fourth embodiment;

FIG. 17 is a second presentation for explaining switching of the resonance frequency of the resonant element according to the fifth embodiment;

DETAILED DESCRIPTION OF THE PREFERRED EMBODIMENTS

In the following, the best mode for carrying out the present invention will be described in detail with reference to the drawings. It should be noted that the scope of the invention is not limited to the illustrated embodiments.

First Embodiment

A resonant element 5 and a wireless communication apparatus 1000 equipped with the resonant element 5 according to a first embodiment will be described first.

<Wireless Communication Apparatus>

First, the configuration of a wireless communication apparatus 1000 will be described.

The wireless communication apparatus 1000 may be, for example, a cellular phone that communicates wirelessly with another wireless communication apparatus such as a base station.

Figure 1:
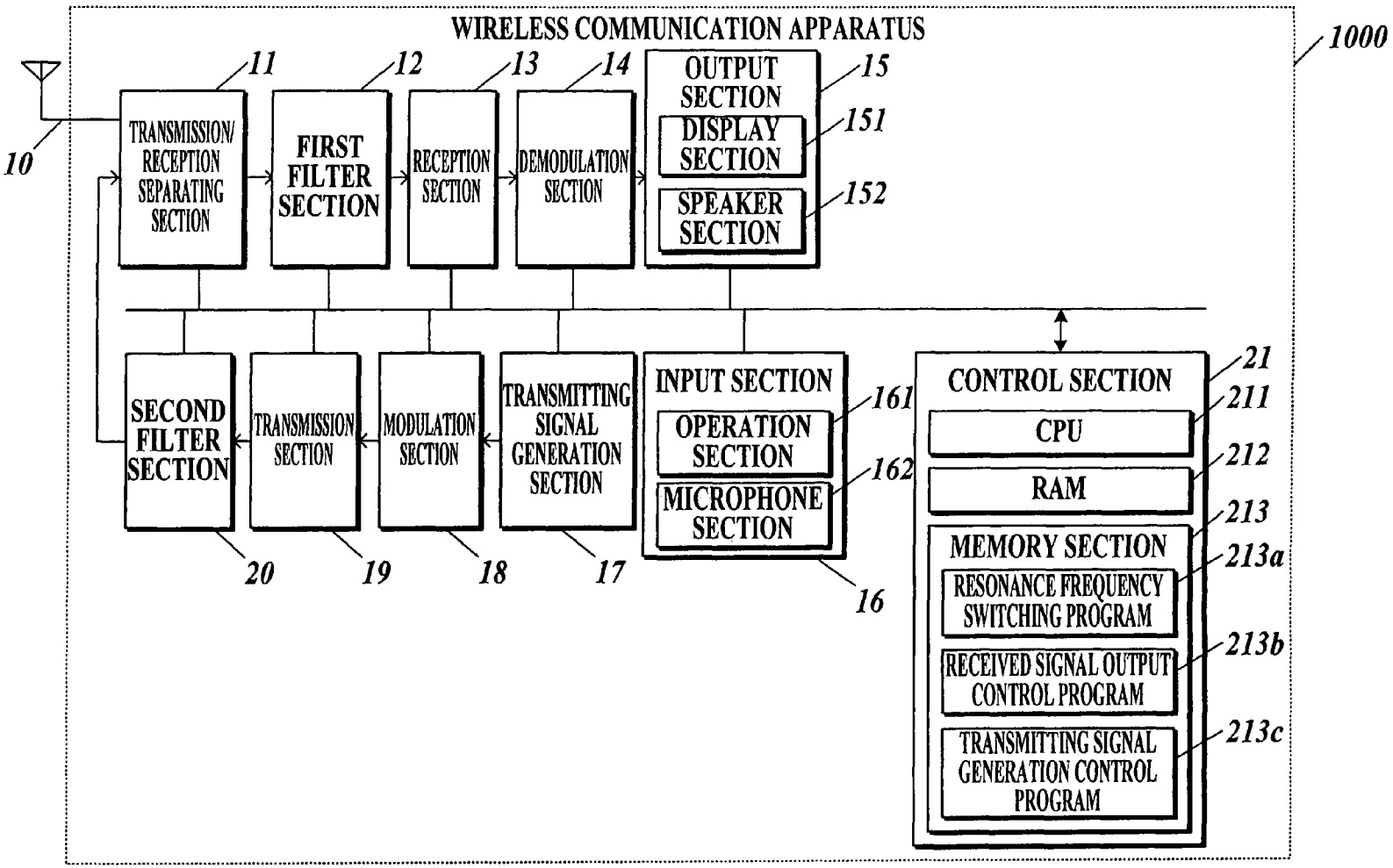
FIG. 1 is a block diagram showing the functional configuration of a wireless communication apparatus according to a first embodiment.

Specifically, as shown in FIG. 1, for example, the wireless communication apparatus 1000 is composed of an antenna 10, a transmission/reception separating section 11, a first filter section 12, a reception section 13, a demodulation section 14, an output section 15, an input section 16, a transmitting signal generation section 17, a modulation section 18, a transmission section 19, a second filter section 20 and a control section 21 etc.

As such, the wireless communication apparatus 1000 is an FDD (Frequency Division Duplex) capable wireless communication apparatus equipped with a filter section for reception (i.e. the first filter section 12) and a filter section for transmission (i.e. the second filter section 20).

The antenna 10 transmits and receives signals (wireless communication signals) to perform wireless communication with another wireless communication apparatus.

Specifically, the antenna 10, for example, receives a signal transmitted from another wireless communication apparatus and outputs it to the transmission/reception separating section 11. In addition, the antenna 10 transmits a signal input from the transmission/reception separating section 11 to the other wireless communication apparatus.

The transmission/reception separating section 11, for example, outputs the signal input from the antenna 10 to the first filter section 12 and outputs a signal input from the second filter section 20 to the antenna 10, in response to a control signal input from the control section 21.

The first filter section 12, for example, obtains a signal located in a predetermined frequency band from the signal input from the transmission/reception separating section 11 and outputs it to the reception section 13, in response to a control signal input from the control section 21.

Figure 2:
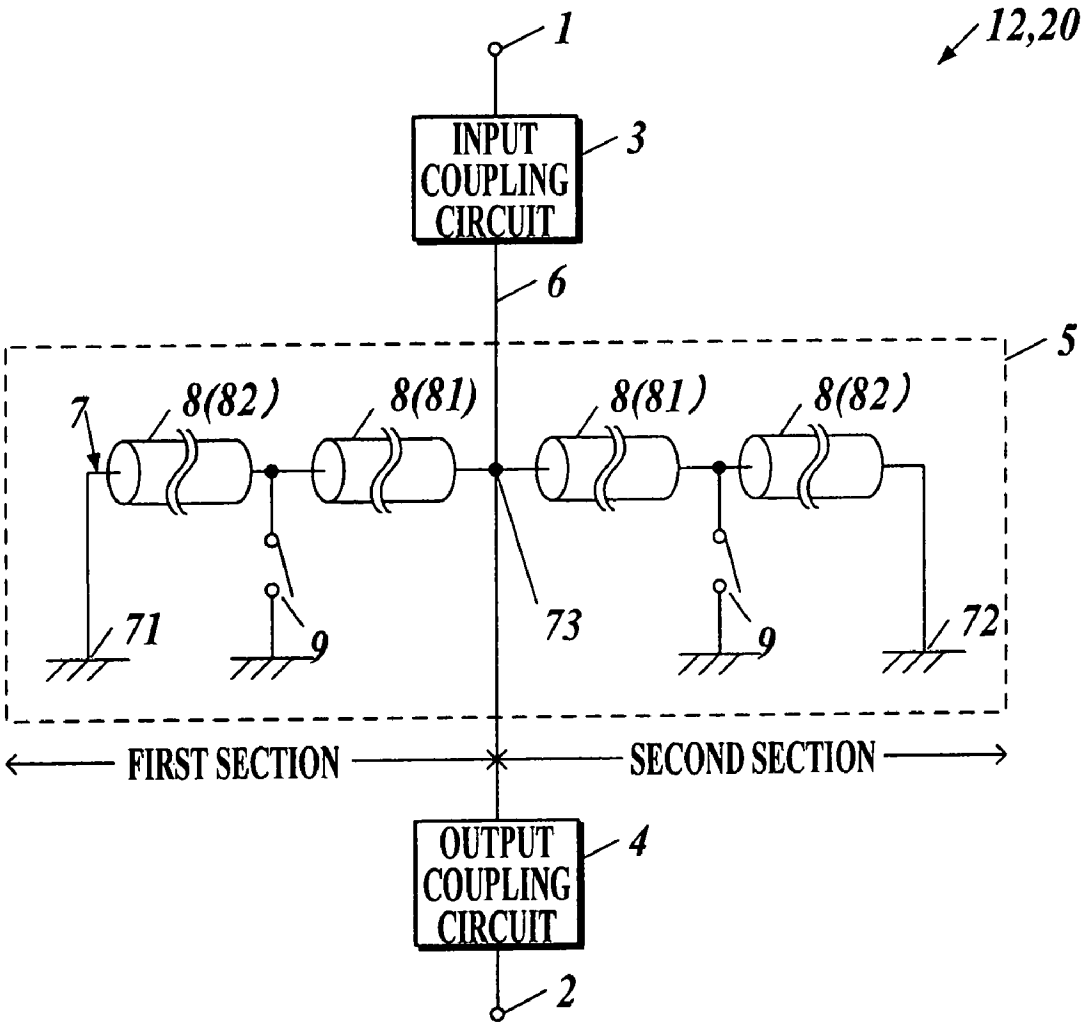
FIG. 2 is a diagram showing the configuration of a resonant element according to the first embodiment.

Specifically, as shown in FIG. 2, for example, the first filter section 12 is composed of an input terminal 1 to which signals from the transmission/reception separating section 11 are input, an input coupling circuit 3, an output coupling circuit 4, an output terminal 2 to output signals to the reception section 13, a hotline 6 that connects the input terminal 1 and the output terminal 2, a resonant element 5 that causes the signal input from the input terminal 1 through the hotline 6 to resonate at a predetermined resonance frequency and outputs it to the output terminal 2 through the hotline 6 etc.

The reception section 13, for example, outputs the signal input from the first filter section 12 to the demodulation section 14 in response to a control signal input from the control section 21.

The demodulation section 14, for example, demodulates the signal input from the reception section 13 and outputs it to the output section 15 in response to a control signal input from the control section 21.

As shown in FIG. 1, the output section 15, for example, includes a display section 151 and a speaker section 152 and outputs signals input from the demodulation section 14 in visible and audible manners.

Specifically, the display section 151, for example, displays an image (video) based on an image (video) signal contained in the signals input from the demodulation section 14.

The speaker section 152, for example, outputs a voice (sound) based on a voice (sound) signal contained in the signals input from the demodulation section 14.

The input section 16, for example, includes an operation section 161 and a microphone section 162 etc. and outputs an input signal entered by a user to the control section 21.

Specifically, the operation section 161, for example, is composed of an operation button or the like and, when operated by the user, outputs an input signal associated with this operation to the control section 21.

When, for example, a voice (or sound) is input, the microphone section 162 converts the voice into an input signal and outputs it to the control section 21.

The transmission signal generating section 17, for example, generates a signal to be transmitted to another wireless communication apparatus and output it to the modulation section 18, in response to a control signal input from the control section 21.

The modulation section 18, for example, modulates the signal input from the transmission signal generation section 17 into a signal for wireless transmission and outputs it to the transmission section 19, in response to a control signal input from the control section 21.

The transmission section 19, for example, outputs the signal input from the modulation section 18 to the second filter section 20 in response to a control signal input from the control section 21.

The second filter section 20, for example, obtains a signal located in a predetermined frequency band from the signal input from the transmission section 19 and outputs it to the transmission/reception separating section 11, in response to a control signal input from the control section 21.

Specifically, as shown in FIG. 2, the second filter section 20 is composed, for example, of an input terminal 1 to which the signal from the transmission section 19 is input, an input coupling circuit 3, an output coupling circuit 4, an output terminal 2 to output a signal to the transmission/reception separating section 11, a hotline 6 and a resonant element 5 etc.

As shown in FIG. 1, the control section 21 is composed, for example, of a CPU (Central Processing Unit) 211, a RAM (Random Access Memory) 212 and a memory section 213 etc.

The CPU 211, for example, performs various control operations in accordance with various processing programs for the wireless communication apparatus 1000 stored in the memory section 213.

The RAM 212, for example, has a program storage area into which the processing programs executed by the CPU 211 are to be loaded and a data storage area in which input data and processing results created by execution of the aforementioned processing programs etc. are to be stored.

The memory section 213, for example, stores a system program that can be executed in the wireless communication apparatus 1000, various processing programs that can be executed by the system program, data used in executing these various processing programs and processing result data computed by the CPU 211 etc. The programs are stored in the form of computer-readable program code in the memory section 213.

Specifically, as shown in FIG. 1, the memory section 213, for example, stores a resonance frequency switching program 213*a*, a received signal output control program 213*b* and a transmitting signal generation control program 213*c* etc.

The resonance frequency switching program 213*a*, for example, causes the CPU 211 to implement a function of switching the resonance frequency of the resonant element 5 provided in the first filter section 12 and switching the resonance frequency of the resonant element 5 provided in the second filter section 20.

Specifically, the CPU 211, for example, switches the resonance frequency of the resonant element 5 provided in the first filter section 12 to a resonant frequency corresponding to the reception radio frequency by turning on/off the switches 9 in the resonant element 5 provided in the first filter section 12 in accordance with resonance frequency switching information input from the input section 16 (operation section 161).

In addition, the CPU 211, for example, switches the resonance frequency of the resonant element 5 provided in the second filter section 20 to a resonant frequency corresponding to the transmission radio frequency by turning on/off the switches 9 in the resonant element 5 provided in the second filter section 20 in accordance with the resonance frequency switching information input from the input section 16 (operation section 161).

Here, the resonance frequency switching information includes, for example, information on a radio frequency desired to be used in the wireless communication apparatus 1000, information on the generation of a mobile communication system desired to be used with the wireless communication apparatus 1000 and/or information on the area in which the wireless communication apparatus 1000 is to be used etc.

The received signal output control program 213*b*, for example, causes the CPU 211 to implement a function of outputting a signal (received signal) transmitted from another wireless communication apparatus and received by the antenna 10 through the output section 15 in visible and audible manners.

Specifically, for example, when the antenna 10 receives a signal transmitted from another wireless communication apparatus, the CPU 211 inputs control signals to the transmission/reception separating section 11, the first filter section 12, the reception section 13, the demodulation section 14 and the output section 15 etc. to cause the received signal to be output through the output section 15 in visible and audible manners.

The transmitting signal generation control program 213*c*, for example, causes the CPU 211 to implement a function of causing the transmitting signal generation section 17 to generates a signal (transmitted signal) to be transmitted to another wireless communication apparatus and causes the signal to be transmitted from the antenna 10 to the aforementioned other wireless communication apparatus.

Specifically, for example, when communication content information is input from the input section 16, the CPU 211 inputs a control signal to the transmitting signal generation section 17 to cause it to generate a signal corresponding to the communication content information and inputs control signals to the modulation section 18, transmission section 19, the second filter section 20 and the transmission/reception separating section 11 etc. to cause the generated signal to be transmitted from the antenna 10 to the aforementioned other wireless communication apparatus.

Here, the communication content information refers, for example, to information on the content communicated with another wireless communication apparatus (e.g. voice information or text information).

<Resonant Element>

Now, the configuration of the resonant element 5 will be described.

The resonant element 5, for example, is an element that is provided in the first filter section 12 and the second filter section 20 of the wireless communication apparatus 1000, and the resonance frequency thereof can be changed.

Figure 3:
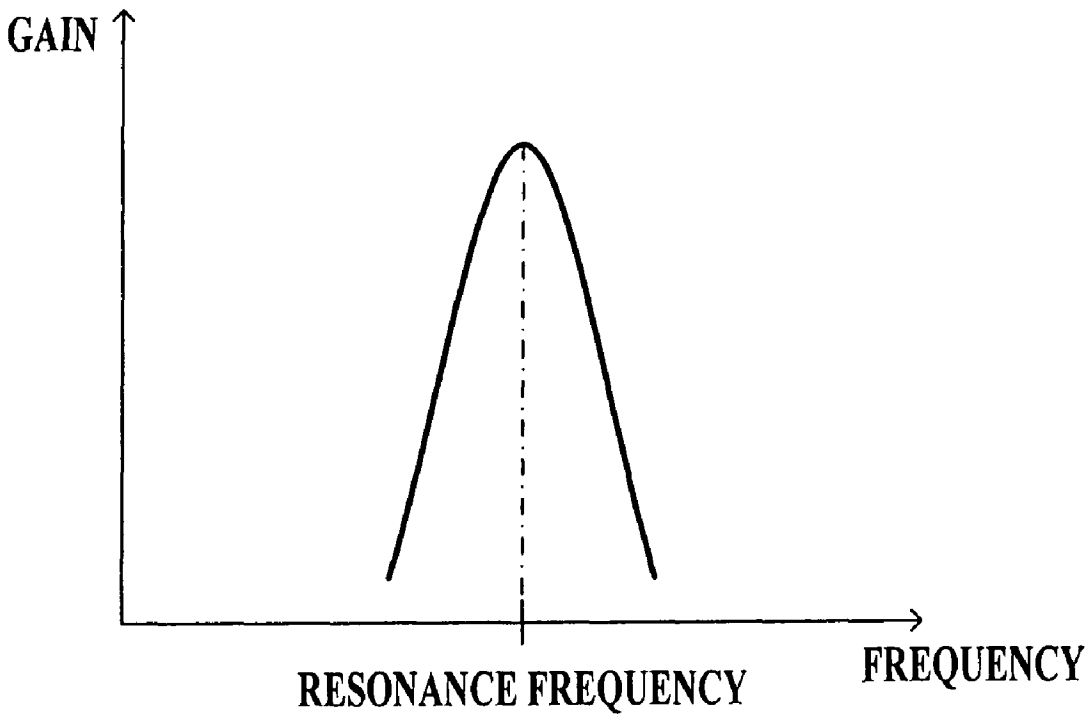
FIG. 3 is a graphical illustration of a signal output from the resonant element according to the first embodiment.

The resonant element 5 causes an input signal to resonate at a predetermined resonance frequency and outputs, for example, a signal that has the maximum gain at the resonance frequency as shown in FIG. 3.

As shown in FIG. 2, the resonant element 5, for example, is loosely coupled with the input terminal 1 by means of the input coupling circuit 3 and also loosely coupled with the output terminal 2 by means of the output coupling circuit 4.

The input coupling circuit 3 and the output coupling circuit 4 are composed of passive elements, such as capacitors, coils, transmission lines etc. and provided for the purpose of, for example, increasing the impedance of the hotline 6.

The input coupling circuit 3 and the output coupling circuit 4 are not necessarily required to be provided.

Specifically, the resonant element 5 is composed, for example, of a transmission line series 7 that includes a plurality of transmission lines 8, 8, . . . connected in series with each other and intersects with the hotline 6, and two switches 9, 9 etc.

The resonant element 5 is adapted to switch the resonance frequency by turning on/off the switches 9 to thereby change the sum of the lengths of the transmission lines 8 through which the signal passes.

The transmission line 8 is, for example, a stripline, a microstrip line, a coplanar line or a coplanar stripline.

The switch 9 is, for example, a MEMS (Micro Electro Mechanical Systems) switch.

A description of a specific configuration of the resonant element 5 will be given while categorizing the transmission lines 8 included in the transmission line series 7 into first transmission lines 81, which are transmission lines each having a fixed length and second transmission lines 82 each of which is a transmission line to which a switch 9 one end of which is a ground end is connected in series at a point between it and an adjacent transmission line 8, and dividing the resonant element 5 into the section extending from the intersection point 73 of the transmission line series 7 and the hotline 6 to one end 71 of the transmission line series 7 (which section will be hereinafter referred to as the first section) and the section extending from the intersection point 73 to the other end 72 of the transmission line series 7 (which section will be hereinafter referred to as the second section).

In the resonant element 5, one end 71 and the other end 72 of the transmission line series 7 are both grounded ends.

In the resonant element 5, furthermore, the transmission line 8 closest to one end 71 of the transmission line series 7 in the first section and the transmission line 8 closest to the other end 72 of the transmission line series 7 in the second section are second transmission lines 82.

Furthermore, the first transmission line 81 is provided in both the first section and the second section. More specifically, the transmission line provided in the first section other than the second transmission line 82 and the transmission line provided in the second section other than the second transmission line 82 are first transmission lines 81.

The transmission lines 8 included in the resonant element 5 may have the same or different lengths and the same or different impedances. In other words, the lengths and impedances of the transmission lines 8 included in the resonant element 5 may be arbitrarily selected on condition that the resonant element 5 can be switched to desired resonance frequencies.

The resonant element 5 provided in the first filter section 12 and the resonant element 5 provided in the second filter section 20 may be the same in respect to all the lengths and impedances of the respective transmission lines 8, differ in respect to some of the lengths and impedances of the respective transmission lines 8, or differ in respect to all the lengths and impedances of the respective transmission lines 8, on condition that the respective resonant elements 5 can be switched to desired resonance frequencies.

Here, switching of the resonance frequency of the resonant element 5 will be described with reference to FIGS. 4 and 5.

Figure 4:
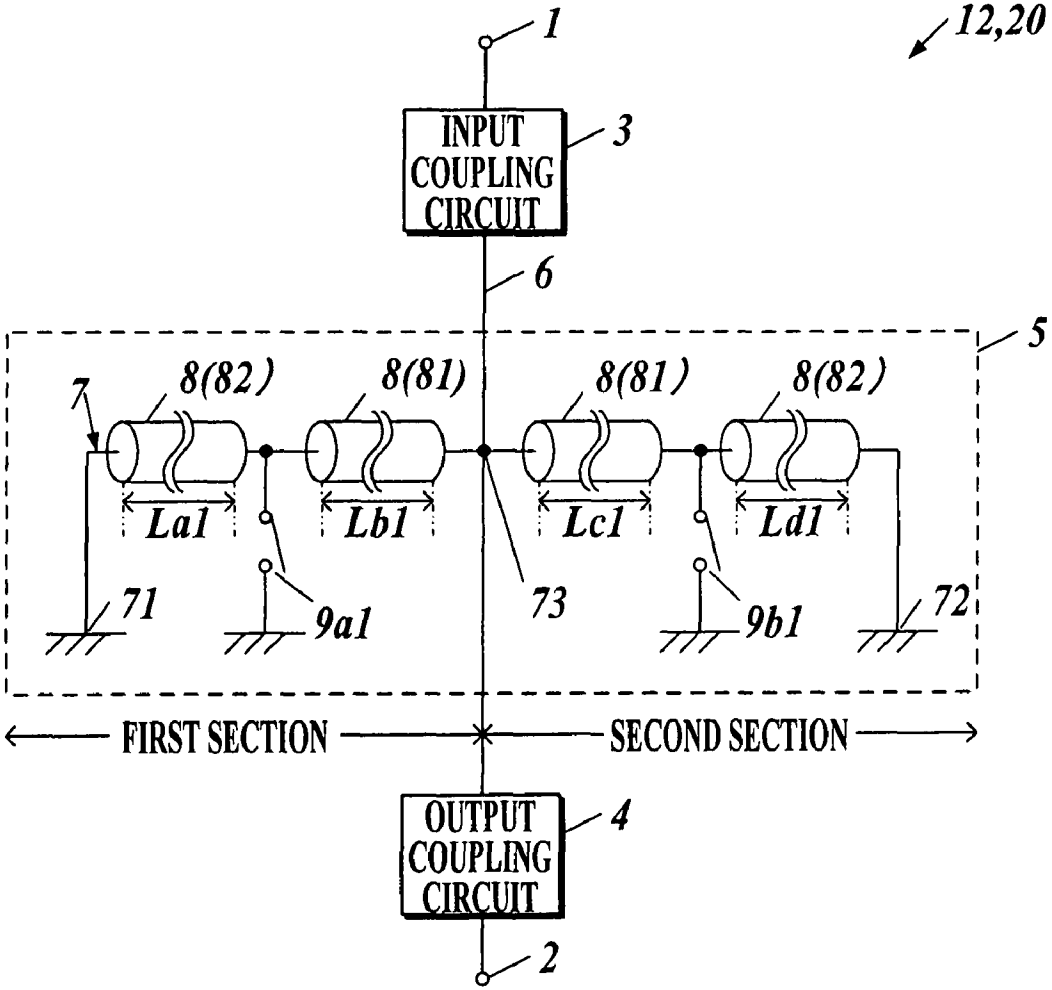
FIG. 4 is a first presentation for explaining switching of the resonance frequency of the resonant element according to the first embodiment.

As shown in FIG. 4, for example, the length of the second transmission line 82 provided in the first section will be represented by "La1", the length of the first transmission line 81 provided in the first section will be represented by "Lb1", the length of the first transmission line 81 provided in the second section will be represented by "Lc1", and the length of the second transmission line 82 provided in the second section will be represented by "Ld1". Furthermore, the switch 9 connected in series with the second transmission line 82 in the first section will be referred to as "switch 9*a*1", and the switch 9 connected in series with the second transmission line 82 in the second section will be referred to as "switch 9*b*1".

As shown in FIG. 5, when, for example, switch 9*a*1 is "ON" and switch 9*b*1 is "ON", the signal input through the input terminal 1 passes through the first transmission line 81 in the first section and the first transmission line 81 in the second section, where resonance occurs, and the signal is output to the output terminal 2. Thus, the sum of the lengths of the transmission lines 8 through which the signal passes (or the resonance length of the transmission line) is equal to "Lb1+Lc1".

When, for example, switch 9*a*1 is "ON" and switch 9*b*1 is "OFF", the signal input through the input terminal 1 passes through the first transmission line 81 in the first section, and the first transmission line 81 and the second transmission line 82 in the second section, where resonance occurs, and the signal is output to the output terminal 2. Thus, the resonance length of the transmission line is equal to "Lb1+Lc1+Ld1".

When, for example, switch 9*a*1 is "OFF" and switch 9*b*1 is "ON", the signal input through the input terminal 1 passes through the first transmission line 81 and the second transmission line 82 in the first section, and the first transmission line 81 in the second section, where resonance occurs, and the signal is output to the output terminal 2. Thus, the resonance length of the transmission line is equal to "La1+Lb1+Lc1".

When, for example, switch 9*a*1 is "OFF" and switch 9*b*1 is "OFF", the signal input through the input terminal 1 passes through the first transmission line 81 and the second transmission line 82 in the first section, and the first transmission line 81 and the second transmission line 82 in the second section, where resonance occurs, and the signal is output to the output terminal 2. Thus, the resonance length of the transmission line is equal to "La1+Lb1+Lc1+Ld1".

As per the above, since the resonant element 5 is equipped with two switches 9, there are four ($=2^n$, where n is the number of the switches) combinations of the statuses of the switches 9. Thus, the resonance length of the transmission line in the resonant element 5 can be changed by changing the statuses of the switches 9.

In this resonant element 5, since one end 71 and the other end 72 of the transmission line series 7 are both grounded ends, and one end of the switch 9 connected in series with the second transmission line 82 is a grounded end, both ends of the path through which the signal passes will be grounded ends. Therefore, the resonant element 5 may have such resonance frequencies at which the resonance length of the transmission line is equal to $\lambda/2$, where $\lambda$ is the wavelength at the resonance frequencies.

Thus, in the resonant element 5 equipped with two switches 9, switching between four ($=2^n$, where n is the number of the switches) resonance frequencies can be achieved.

The resonant element 5 according to the first embodiment described in the foregoing has a transmission line series 7 that includes a plurality of transmission lines 8, 8, . . . connected in series with each other and intersects with the hotline 6 that connects the input terminal 1 and the output terminal 2, and two switches 9, 9 etc. The resonant element 5 is adapted to switch the resonance frequency by turning on/off the switches 9 to thereby change the sum of the lengths of the transmission lines 8 through which the signal passes. Specifically, in the resonant element 5, one end 71 and the other end 72 of the transmission line series 7 are both grounded ends, the transmission line 8 closest to one end 71 of the transmission line series 7 in the first section and the transmission line 8 closest to the other end 72 of the transmission line series 7 in the second section are second transmission lines 82, and both the first and second sections are provided with the first transmission line 81.

Thus, the number of the switchable resonance frequencies of the resonant element 5 is equal to the number of combinations of the statuses of the switches 9 (i.e. $2^n$, where n is the number of the switches), which means that the number of the switches is minimum for the number of the switchable resonance frequencies. Therefore, the signal loss can be made small.

Furthermore, the resonant element 5 has a simple configuration including only transmission lines 8 and switches 9, switching between a plurality of resonance frequencies can be achieved only with the single resonant element 5, and the number of the switches 9 is minimum. Therefore, increases in the size of the circuit and increases in the number of parts can be prevented.

Thus, switching between a plurality of (or four) resonance frequencies can be achieved by a simple configuration with low signal loss.

Furthermore, in the resonant element 5, the number of the switchable resonance frequencies is equal to the number of combinations of the statuses of the switches 9 (i.e. $2^n$, where n is the number of the switches), which means that the number of the switchable resonance frequencies is maximum for the number of the switches 9. Therefore, in cases where the number of currently desired switchable resonance frequencies is larger than $2^{n-1}$ (where n is the number of the switches) and smaller than $2^n$ (where n is the number of the switches), the resonant element 5 can be adapted for addition of a switchable resonance frequency(ies), if a desired switchable resonance frequency(ies) is added later.

In the resonant element 5 according to the first embodiment, the switches 9 are MEMS switches.

Therefore, they are advantageous in that a plurality of switches 9 can be produced by a single process, the capacitance is small when the switch 9 is OFF, and signal loss is small.

Since the wireless communication apparatus 1000 according to the first embodiment is equipped with the resonant element 5, a plurality of (or four) radio frequencies can be set.

Second Embodiment

Next, a resonant element 5A according to a second embodiment will be described.

Since the wireless communication apparatus 1000 according to the second embodiment differs from the wireless communication apparatus 1000 according to the first embodiment only in the configuration of the resonant element, detailed description thereof will be omitted.

<Resonant Element>

The resonant element 5A differs from the resonant element 5 according to the first embodiment only in that the other end 72A of the transmission line 7A is an open end. Accordingly, only the different portions will be described, and other common portions will be denoted by the same reference signs to omit detailed description.

Figure 6:
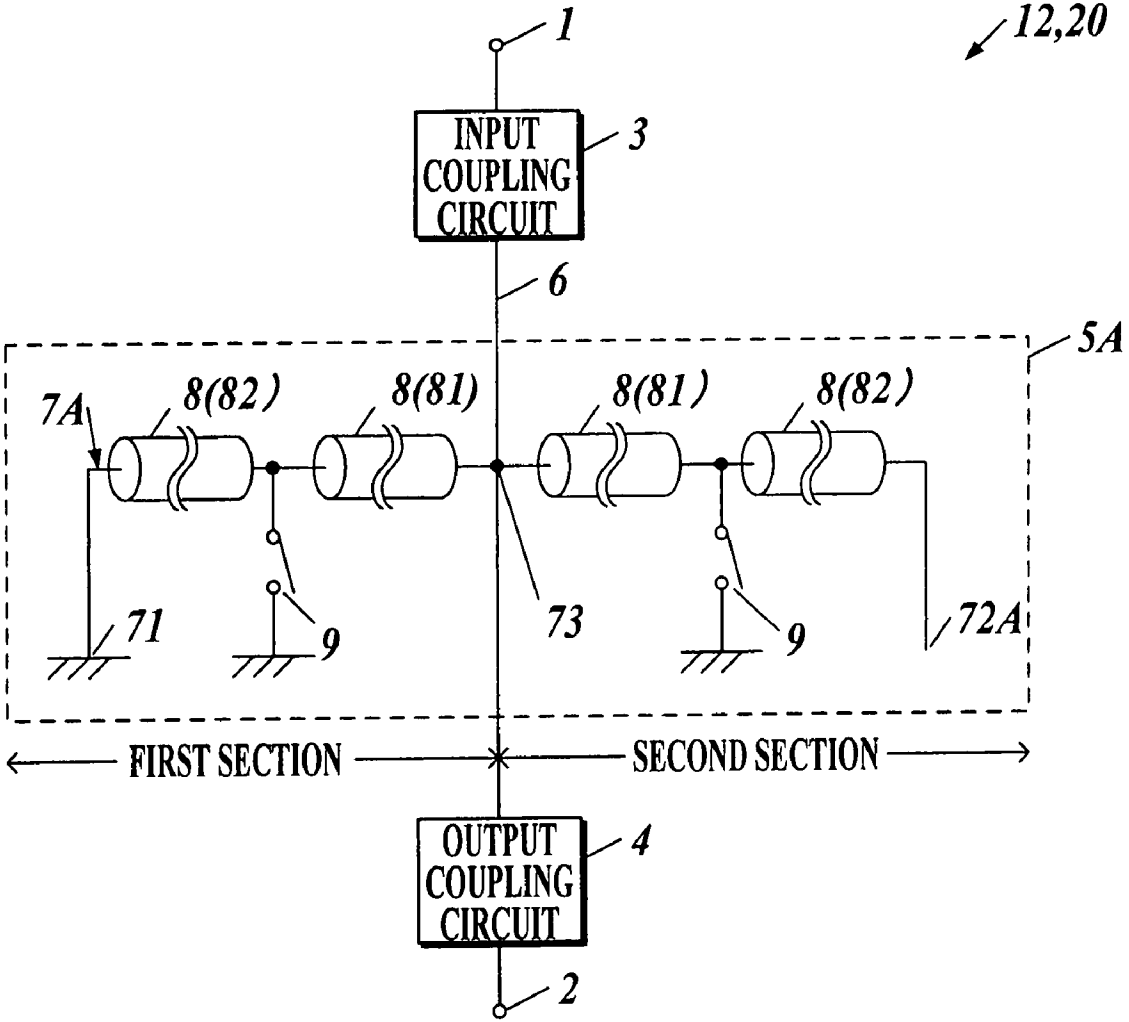
FIG. 6 is a diagram showing the configuration of a resonant element according to a second embodiment.

As shown in FIG. 6, for example, the resonant element 5A is composed of a transmission line series 7A that includes a plurality of transmission lines 8, 8, . . . connected in series with each other and intersects with the hotline 6, and two switches 9, 9 etc.

In the resonant element 5A, one end 71 of the transmission line series 7A is a grounded end and the other end 72A is an open end.

Here, switching of the resonance frequency of the resonant element 5A will be described with reference to FIGS. 7 and 8.

Figure 7:
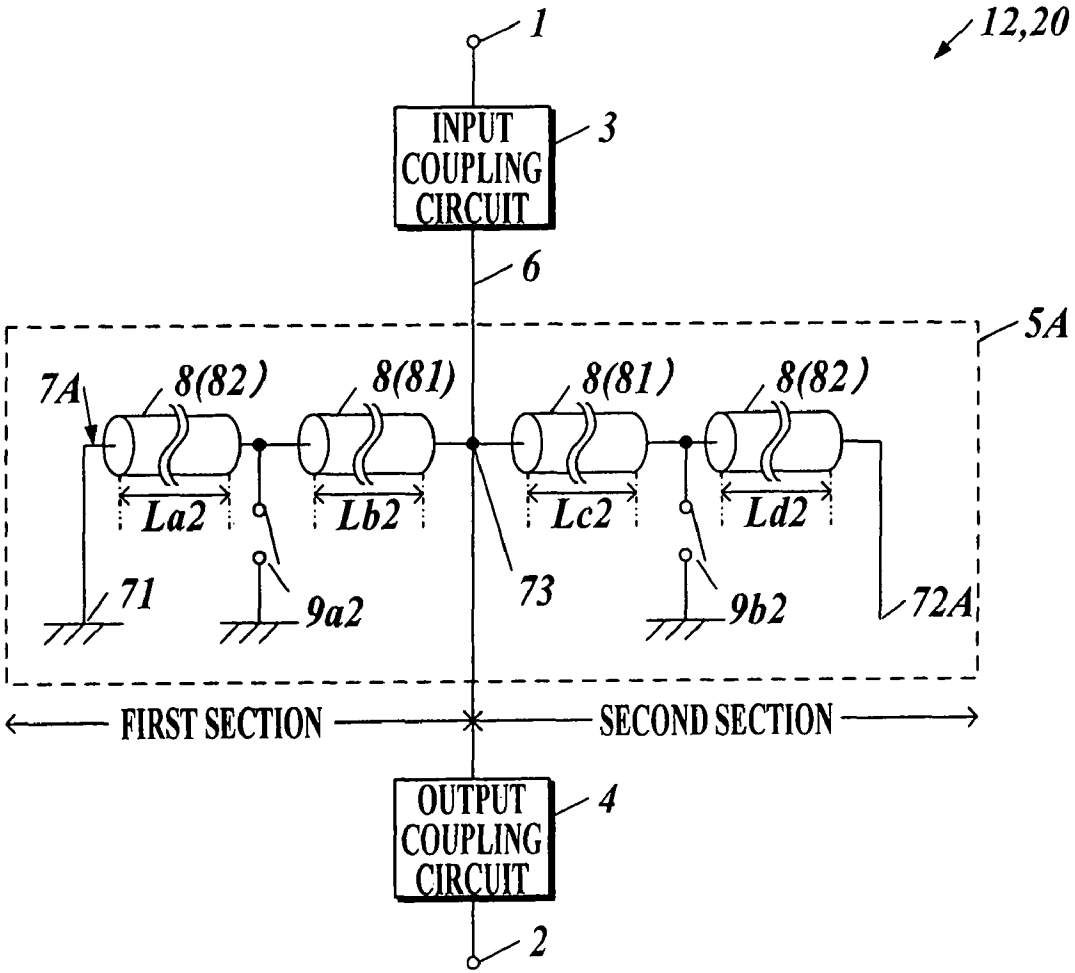
FIG. 7 is a first presentation for explaining switching of the resonance frequency of the resonant element according to the second embodiment.

As shown in FIG. 7, for example, the length of the second transmission line 82 provided in the first section will be represented by "La2", the length of the first transmission line 81 provided in the first section will be represented by "Lb2", the length of the first transmission line 81 provided in the second section will be represented by "Lc2", the length of the second transmission line 82 provided in the second section will be represented by "Ld2". In addition, the switch 9 connected in series with the second transmission line 82 in the first section will be referred to as "switch 9*a*2", and the switch 9 connected in series with the second transmission line 82 in the second section will be referred to as "switch 9*b*2".

Since the resonant element 5A is equipped with two switches 9 as shown in FIG. 8, there are four ($=2^n$, where n is the number of the switches) combinations of the statuses of the switches 9. Thus, the resonance length of the transmission line in the resonant element 5A can be changed by changing the statuses of the switches 9.

In the resonant element 5A, one end 71 of the transmission line 7A is a grounded end, the other end 72A is an open end, and one end of the switch 9 connected to the second transmission line 82 is a grounded end. Accordingly, when the switch 9 (switch 9*b*2) connected in series with the second transmission line 82 in the second section is ON, both ends of the path through which the signal passes are grounded ends, and therefore the resonant element 5A may have such resonance frequencies at which the resonance length of the transmission line is equal to $\lambda/2$. On the other hand, when the switch 9 (switch 9*b*2) connected in series with the second transmission line 82 in the second section is OFF, one end of the path through which the signal passes is a grounded end and the other end is an open end, and therefore the resonant element 5A may have such resonance frequencies at which the resonance length of the transmission line is equal to $\lambda/4$.

Thus, in the resonant element 5A equipped with two switches 9, switching between four ($=2^n$, where n is the number of the switches) resonance frequencies can be achieved.

Furthermore, by turning on/off the switch 9 connected in series with the second transmission line 82 in the second section, switching between a resonance frequency at which the resonance length of the transmission line is equal to $\lambda/2$ and a resonance frequency at which the resonance length of the transmission line is equal to λ/4 can be achieved, whereby the resonance frequency can be varied approximately twofold between when the switch 9 connected in series with the second transmission line 82 in the second section is ON and when it is OFF.

According to the resonant element 5A according to the second embodiment described in the foregoing, switching between a plurality of (or four) resonance frequencies can be achieved by a simple configuration with low signal loss. In addition, in the resonant element 5A, since one end 71 of the transmission line series 7A is a grounded end and the other end 72A is an open end, switching between a resonance frequency at which the resonance length of the transmission line is equal to λ/2 and a resonance frequency at which the resonance length of the transmission line is equal to λ/4 can be achieved by turning on/off the switch 9 connected in series with the second transmission line 82 in the second section. Thus, switching over a frequency range wider than that in the resonant element 5 according to the first embodiment can be achieved.

Third Embodiment

Next, a resonant element 5B according to a third embodiment will be described.

Since the wireless communication apparatus 1000 according to the third embodiment differs from the wireless communication apparatus according to the first embodiment only in the configuration of the resonant element, detailed description thereof will be omitted.

<Resonant Element>

The resonant element 5B differs from the resonant element 5 according to the first embodiment only in that transmission lines 8 to which switches 9 are connected in parallel are provided. Accordingly, only the different portions will be described, and other common portions will be denoted by the same reference signs to omit detailed description.

Figure 9:
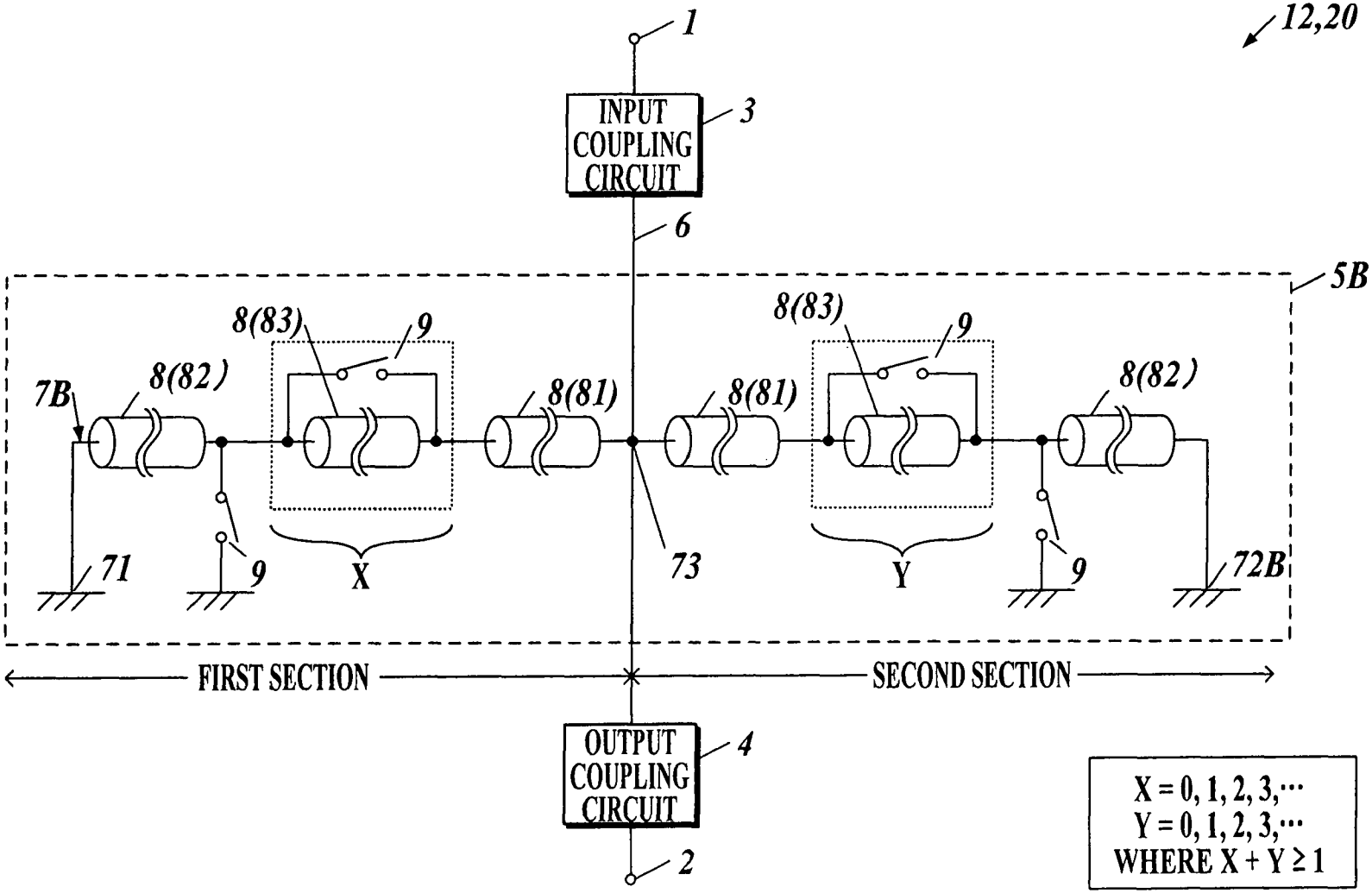
FIG. 9 is a diagram showing the configuration of a resonant element according to a third embodiment.

As shown in FIG. 9, for example, the resonant element 5B is composed of a transmission line series 7B that includes a plurality of transmission lines 8, 8, . . . connected in series with each other and intersects with the hotline 6, and a plurality of switches 9, 9 etc.

A description of a specific configuration of the resonant element 5B will be given while categorizing the transmission lines 8 included in the transmission line series 7B into first transmission lines 81, second transmission lines 82 and third transmission lines 83 each of which is a transmission line to which a switch 9 is connected in parallel, and dividing the resonant element 5B into a first section and a second section.

In the resonant element 5B, one end 71 and the other end 72B of the transmission line series 7B are both grounded ends.

In the resonant element 5B, furthermore, the transmission line 8 closest to one end 71 of the transmission line series 7B in the first section and the transmission line 8 closest to the other end 72B of the transmission line series 7B in the second section are second transmission lines 82.

Furthermore, the third transmission line 83 is provided in at least one of the first and second sections, and the first transmission line 81 is provided in both the first and second sections. Here, given the conditions "X=0, 1, 2, 3, . . . ", "Y=0, 1, 2, 3, . . . " and "X+Y≧1", where X is the number of the third transmission lines 83 provided in the first section and Y is the number of the third transmission lines 83 provided in the second section, the transmission lines provided in the first section other than the second transmission line 82 include a first transmission line(s) 81 and X third transmission lines 83, and the transmission lines provided in the second section other than the second transmission line 82 include a first transmission line(s) 81 and Y third transmission lines 83.

Here, the number of the first transmission lines 81 provided in the first section and the number of the first transmission lines 81 provided in the second section may be either one or more than one.

The arrangement of the first transmission lines 81 and the third transmission lines 83 in the first section and the arrangement of the first transmission lines 81 and the third transmission lines 83 in the second section may be arbitrarily designed. Specifically, for example, the first transmission lines 81 may be arranged to be closer to the intersection point 73 than the third transmission lines 83, or the third transmission lines 83 may be arranged to be closer to the intersection point 73 than the first transmission lines 81. In the case where there are plurality of first transmission lines 81 and a plurality of third transmission lines 83 in the first section or the second section, the first transmission lines 81 and the third transmission lines 83 may be arranged alternately.

Here, switching of the resonance frequency of the resonant element 5B in the case where X=1 and Y=1 will be described with reference to FIGS. 10 and 11.

Figure 10:
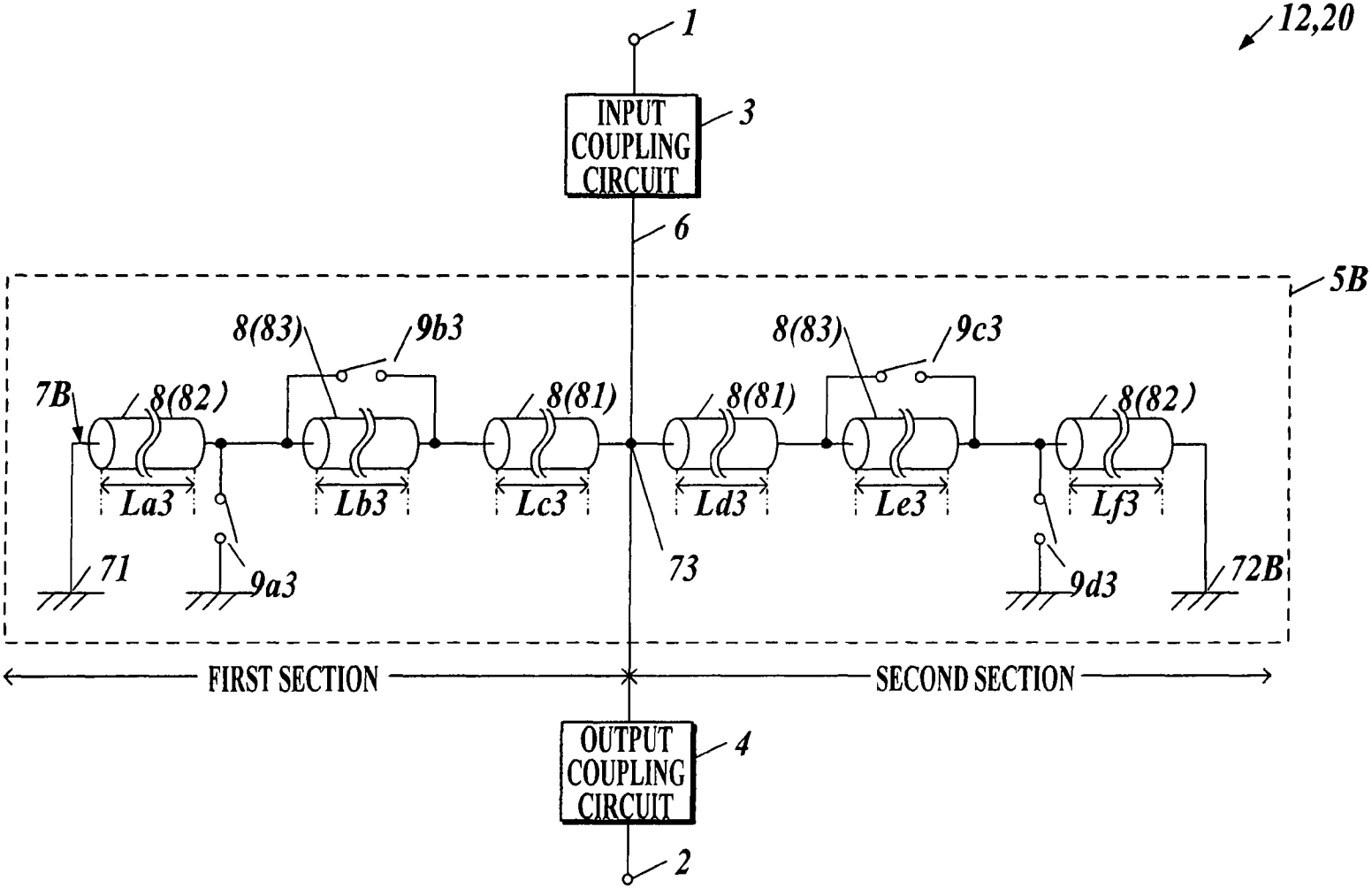
FIG. 10 is a first presentation for explaining switching of the resonance frequency of the resonant element according to the third embodiment.

As shown in FIG. 10, for example, the length of the second transmission line 82 provided in the first section will be represented by "La3", the length of the third transmission line 83 provided in the first section will be represented by "Lb3", the length of the first transmission line 81 provided in the first section will be represented by "Lc3", the length of the first transmission line 81 provided in the second section will be represented by "Ld3", the length of the third transmission line 83 provided in the second section will be represented by "Le3", and the length of the second transmission line 82 provided in the second section will be represented by "Lf3". In addition, the switch 9 connected in series with the second transmission line 82 in the first section will be referred to as "switch 9*a*3", the switch 9 connected in parallel with the third transmission line 83 in the first section will be referred to as "switch 9*b*3", the switch 9 connected in parallel with the third transmission line 83 in the second section will be referred to as "switch 9*c*3" and the switch 9 connected in series with the second transmission line 82 in the second section will be referred to as "switch 9*d*3".

As shown in FIG. 11, since the resonant element 5B is equipped with four switches 9, there are sixteen ($=2^n$, where n is the number of the switches) combinations of the statuses of the switches 9. Thus, the resonance length of the transmission line in the resonant element 5B can be changed by changing the statuses of the switches 9.

In this resonant element 5B, since one end 71 and the other end 72B of the transmission line series 7B are both grounded ends, and one end of the switch 9 connected in series with the second transmission line 82 is a grounded end, both ends of the path through which the signal passes will be grounded ends. Therefore, the resonant element 5B may have such resonance frequencies at which the resonance length of the transmission line is equal to λ/2.

Thus, in the resonant element 5B equipped with four switches 9 where X=1 and Y=1, switching between sixteen ($=2^n$, where n is the number of the switches) resonance frequencies can be achieved.

The number (X) of the third transmission lines 83 provided in the first section and the number (Y) of the third transmission lines 83 provided in the second section are not limited to "X=1 and Y=1", but they may be arbitrarily selected on condition that the conditions "X=0, 1, 2, 3, . . . ", "Y=0, 1, 2, 3, . . . " and "X+Y≧1" are satisfied.

In the resonant element 5B, the condition "X=1 and Y=1" is not essential, but switching between $2^n$ (n is the number of the switches) resonance frequencies can be achieved if the conditions "X=0, 1, 2, 3, . . . ", "Y=0, 1, 2, 3, . . . " and "X+Y≧1" are satisfied.

In the resonant element 5B according to the third embodiment described in the foregoing, one end 71 and the other end 72B of the transmission line series 7B are both grounded ends, the transmission line 8 closest to one end 71 of the transmission line series 7B in the first section and the transmission line closest to the other end 72B of the transmission line series 7B in the second section are second transmission lines 82, at least one of the first and second sections is provided with the third transmission line 83, and both the first and second sections are provided with the first transmission line 81.

Therefore, switching between a plurality of (or $2^n$, where n is the number of the switches) resonance frequencies can be achieved by a simple configuration with low signal loss, and the number of the switches 9 may be increased or decreased in accordance with the number of desired switchable resonance frequencies.

Since the wireless communication apparatus 1000 according to the third embodiment is equipped with the resonant element 5B, a plurality of (or $2^n$, where n is the number of the switches) radio frequencies can be set.

Fourth Embodiment

Next, a resonant element 5C according to a fourth embodiment will be described.

Since the wireless communication apparatus 1000 according to the fourth embodiment differs from the wireless communication apparatus 1000 according to the first embodiment only in the configuration of the resonant element, detailed description thereof will be omitted.

<Resonant Element>

The resonant element 5C differs from the resonant element 5B according to the third embodiment only in that the other end 72C of the transmission line 7C is an open end. Accordingly, only the different portions will be described, and other common portions will be denoted by the same reference signs to omit detailed description.

Figure 12:
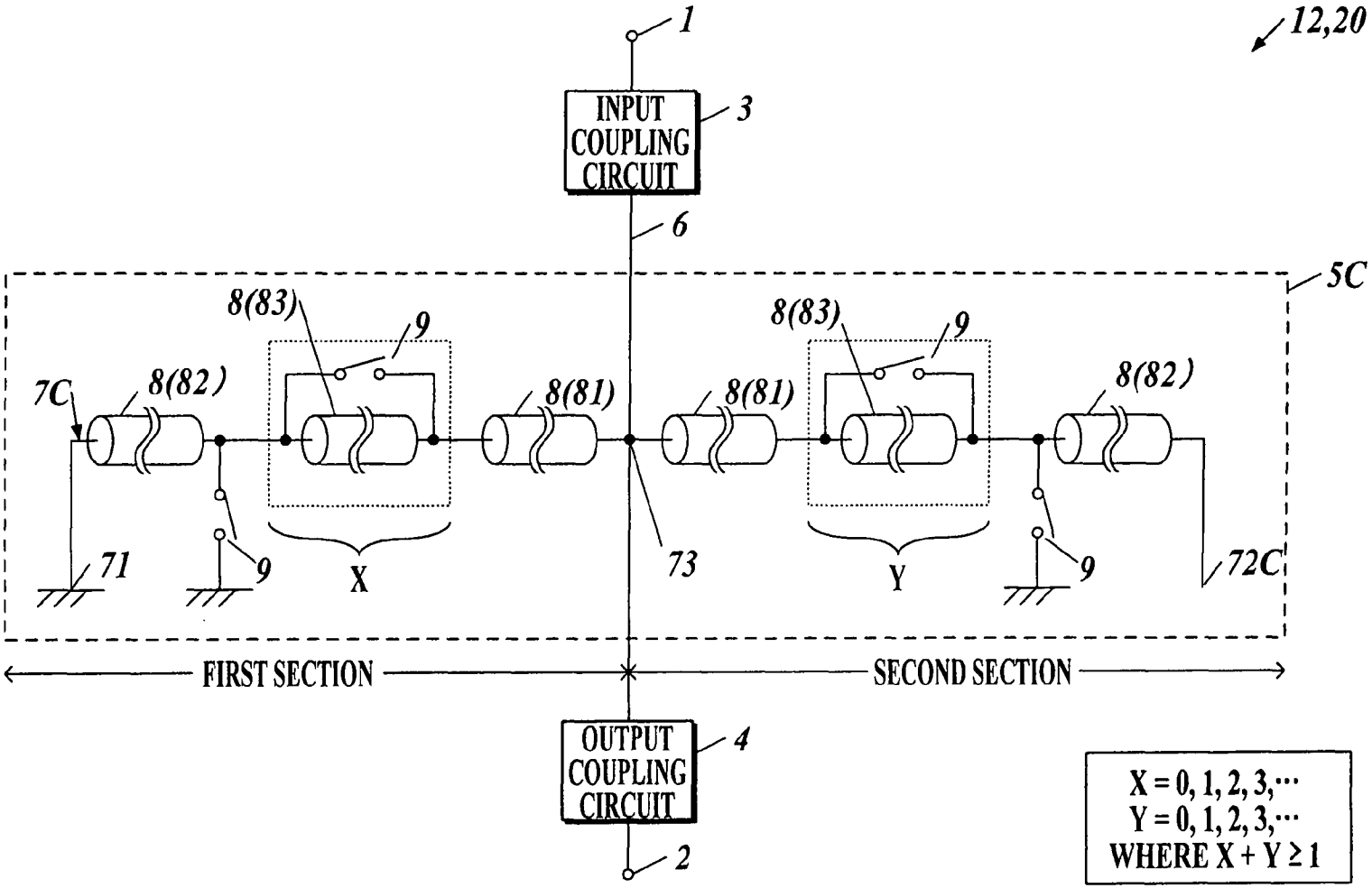
FIG. 12 is a diagram showing the configuration of a resonant element according to a fourth embodiment.

As shown in FIG. 12, for example, the resonant element 5C is composed of a transmission line series 7C that includes a plurality of transmission lines 8, 8, . . . connected in series with each other and intersects with the hotline 6, and plurality of switches 9, 9 etc.

In the resonant element 5C, one end 71 of the transmission line series 7C is a grounded end and the other end 72C is an open end.

Here, switching of the resonance frequency of the resonant element 5C in the case where X=1 and Y=1 will be described with reference to FIGS. 13 and 14.

Figure 13:
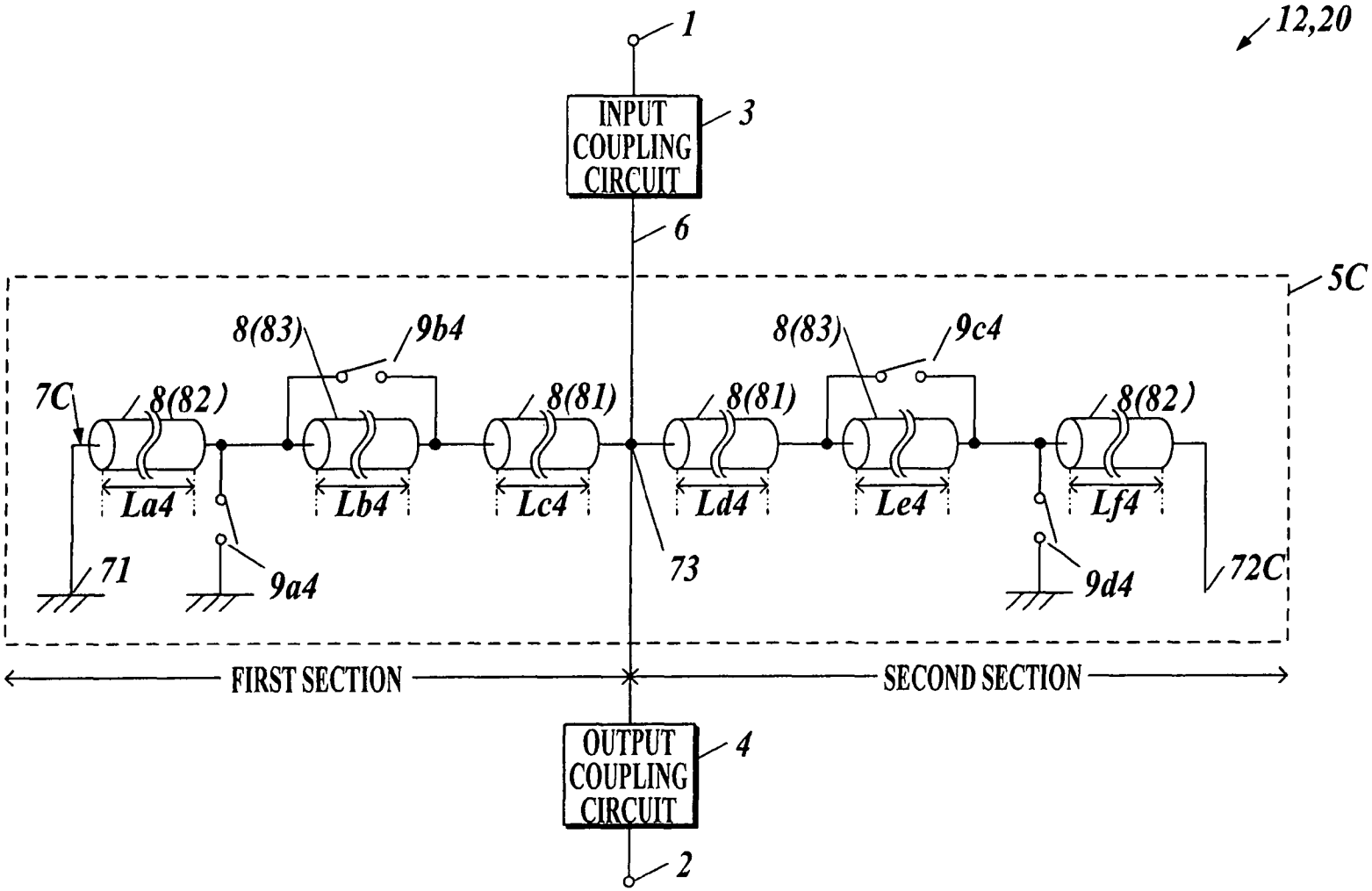
FIG. 13 is a first presentation for explaining switching of the resonance frequency of the resonant element according to the fourth embodiment.

As shown in FIG. 13, for example, the length of the second transmission line 82 provided in the first section will be represented by "La4", the length of the third transmission line 83 provided in the first section will be represented by "Lb4", the length of the first transmission line 81 provided in the first section will be represented by "Lc4", the length of the first transmission line 81 provided in the second section will be represented by "Ld4", the length of the third transmission line 83 provided in the second section will be represented by "Le4", and the length of the second transmission line 82 provided in the second section will be represented by "Lf4".

In addition, the switch 9 connected in series with the second transmission line 82 in the first section will be referred to as "switch 9*a*4", the switch 9 connected in parallel with the third transmission line 83 in the first section will be referred to as "switch 9*b*4", the switch 9 connected in parallel with the third transmission line 83 in the second section will be referred to as "switch 9*c*4" and the switch 9 connected in series with the second transmission line 82 in the second section will be referred to as "switch 9*d*4".

As shown in FIG. 14, since the resonant element 5C is equipped with four switches 9, there are sixteen (=$2^n$, where n is the number of the switches) combinations of the statuses of the switches 9. Thus, the resonance length of the transmission line in the resonant element 5C can be changed by changing the statuses of the switches 9.

In this resonant element 5C, one end 71 of the transmission line series 7C is a grounded end, the other end 72C is an open end, and one end of the switch 9 connected in series with the second transmission line 82 is a grounded end. Accordingly, when the switch 9 (switch 9*d*4) connected in series with the second transmission line 82 in the second section is ON, both ends of the path through which the signal pass are grounded ends, and therefore the resonant element 5C may have such resonance frequencies at which the resonance length of the transmission line is equal to λ/2. On the other hand, when the switch 9 (switch 9*d*4) connected in series with the second transmission line 82 in the second section is OFF, one end of the path through which the signal pass is a grounded end and the other end is an open end, and therefore the resonant element 5C may have such resonance frequencies at which the resonance length of the transmission line is equal to λ/4.

Thus, in the resonant element 5C equipped with four switches 9 where X=1 and Y=1, switching between sixteen (=$2^n$, where n is the number of the switches) resonance frequencies can be achieved.

Furthermore, by turning on/off the switch 9 connected in series with the second transmission line 82 in the second section, switching between a resonance frequency at which the resonance length of the transmission line is equal to λ/2 and a resonance frequency at which the resonance length of the transmission line is equal to λ/4 can be achieved, whereby the resonance frequency can be varied approximately twofold between when the switch 9 connected in series with the second transmission line 82 in the second section is ON and when it is OFF.

The number (X) of the third transmission lines 83 provided in the first section and the number (Y) of the third transmission lines 83 provided in the second section are not limited to "X=1 and Y=1", but they may be arbitrarily selected on condition that the conditions "X=0, 1, 2, 3, . . . ", "Y=0, 1, 2, 3, . . . " and "X+Y≧1" are satisfied.

In the resonant element 5B, the condition "X=1 and Y=1" is not essential, but switching between $2^n$ (n is the number of the switches) resonance frequencies can be achieved if the conditions "X=0, 1, 2, 3, . . . ", "Y=0, 1, 2, 3, . . . " and "X+Y≧1" are satisfied.

According to the resonant element 5C according to the fourth embodiment described in the foregoing, switching between a plurality of (or $2^n$, where n is the number of the switches) resonance frequencies can be achieved by a simple configuration with low signal loss. In addition, in the resonant element 5C, since one end 71 of the transmission line series 7C is a grounded end and the other end 72C is an open end, switching between a resonance frequency at which the resonance length of the transmission line is equal to λ/2 and a resonance frequency at which the resonance length of the transmission line is equal to λ/4 can be achieved by turning on/off the switch 9 connected in series with the second transmission line 82 in the second section. Thus, switching over a frequency range wider than that in the resonant element 5B according to the third embodiment can be achieved.

Fifth Embodiment

Next, a resonant element 5D according to a fifth embodiment will be described.

Since the wireless communication apparatus 1000 according to the fifth embodiment differs from the wireless communication apparatus 1000 according to the first embodiment only in the configuration of the resonant element, detailed description thereof will be omitted.

<Resonant Element>

The resonant element 5D differs from the resonant element 5C according to the fourth embodiment only in that there is no second transmission line 82 in the second section, and there are z (Z=0, 1, 2, 3, . . . ) first transmission lines 81 in the second section. Accordingly, only the different portions will be described, and other common portions will be denoted by the same reference signs to omit detailed description.

Figure 15:
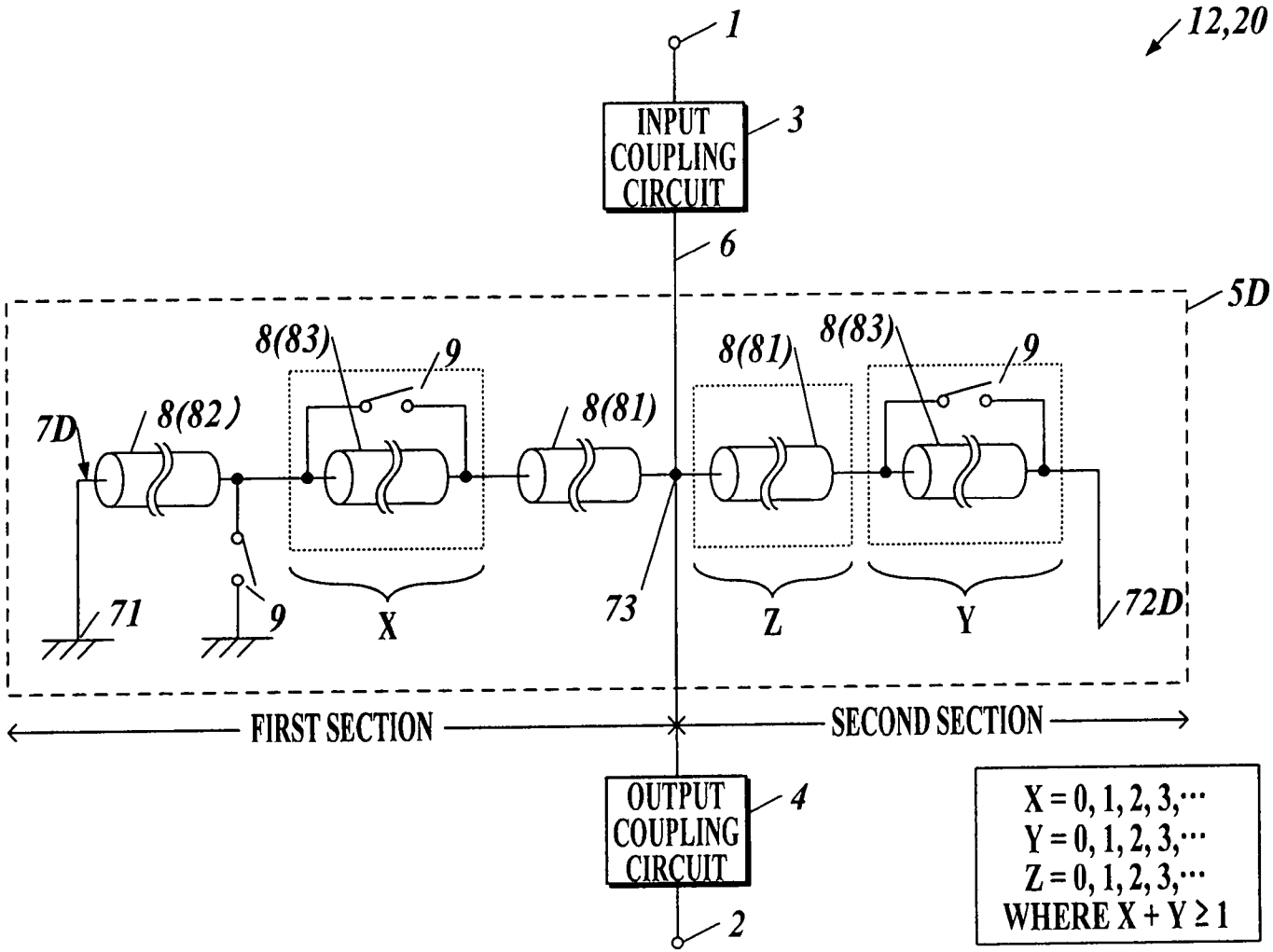
FIG. 15 is a diagram showing the configuration of a resonant element according to a fifth embodiment.

As shown in FIG. 15, for example, the resonant element 5D is composed of a transmission line series 7D that includes a plurality of transmission lines 8, 8, . . . connected in series with each other and intersects with the hotline 6, and a plurality of switches 9, 9 etc.

In the resonant element 5D, one end 71 of the transmission line series 7D is a grounded end and the other end 72D is an open end.

In the resonant element 5D, furthermore, the transmission line 8 closest to one end 71 of the transmission line series 7D in the first section is the second transmission line 82.

Furthermore, the third transmission line 83 is provided in at least one of the first and second sections, and the first transmission line 81 is provided in at least in the first section among the first and second sections. Here, given the conditions "X=0, 1, 2, 3, . . . ", "Y=0, 1, 2, 3, . . . ", "Z=0, 1, 2, 3, . . . " and "X+Y≧1", where X is the number of the third transmission lines 83 provided in the first section, Y is the number of the third transmission lines 83 provided in the second section, and Z is the number of the first transmission lines 81 provided in the second section, the transmission lines provided in the first section other than the second transmission line 82 include a first transmission line(s) 81 and X third transmission lines 83, and the transmission lines provided in the second section include Z first transmission lines 81 and Y third transmission lines 83.

The arrangement of the first transmission lines 81 and the third transmission lines 83 in the first section and the arrangement of the first transmission lines 81 and the third transmission lines 83 in the second section may be arbitrarily designed.

Here, switching of the resonance frequency of the resonant element 5D in the case where X=1, Y=2 and Z=1 will be described with reference to FIGS. 16 and 17.

Figure 16:
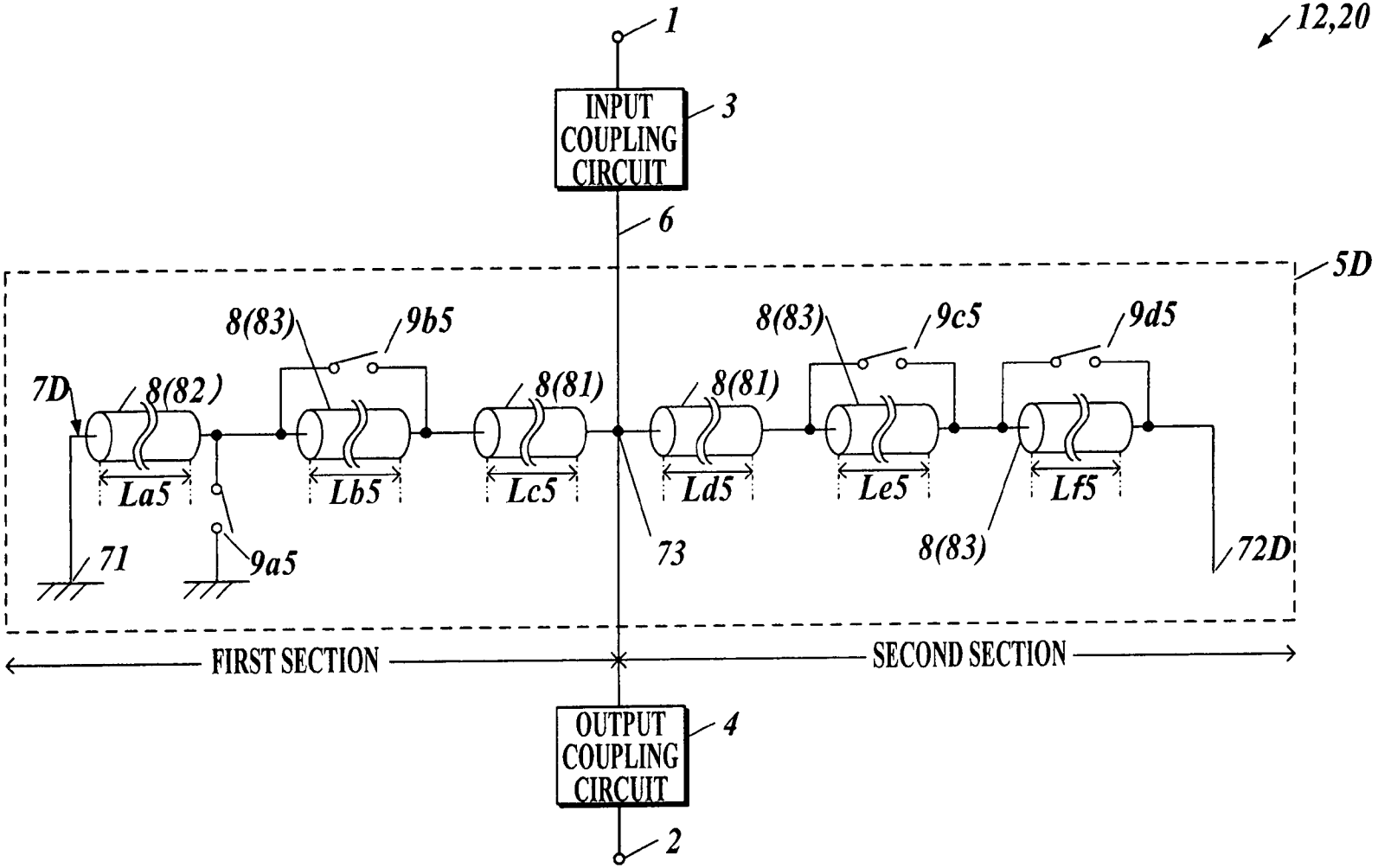
FIG. 16 is a first presentation for explaining switching of the resonance frequency of the resonant element according to the fifth embodiment.

As shown in FIG. 16, for example, the length of the second transmission line 82 provided in the first section will be represented by "La5", the length of the third transmission line 83 provided in the first section will be represented by "Lb5", the length of the first transmission line 81 provided in the first section will be represented by "Lc5", the length of the first transmission line 81 provided in the second section will be represented by "Ld5", and the lengths of the third transmission lines 83 provided in the second section will be represented by "Le5" and "Lf5". In addition, the switch 9 connected in series with the second transmission line 82 in the first section will be referred to as "switch 9*a*5", the switch 9 connected in parallel with the third transmission line 83 in the first section will be referred to as "switch 9*b*5", and the switches 9 connected in parallel with the third transmission lines 83 in the second section will be referred to as "switch 9*c*5" and "switch 9*d*5".

As shown in FIG. 17, since the resonant element 5D is equipped with four switches 9, there are sixteen ($=2^n$, where n is the number of the switches) combinations of the statuses of the switches 9. Thus, the resonance length of the transmission line in the resonant element 5B can be changed by changing the statuses of the switches 9.

In this resonant element 5D, one end 71 of the transmission line series 7D is a ground end, the other end 72D thereof is an open end, and one end of the switch 9 connected in series with the second transmission line 82 is a grounded end. Accordingly, one end of the path through which the signal passes will be a ground end, and the other end thereof will be an open end. Therefore, the resonant element 5D may have such resonance frequencies at which the resonance length of the transmission line is equal to λ/4.

Thus, in the resonant element 5D equipped with four switches 9 where X=1 and Y=2 and Z=1, switching between sixteen ($=2^n$, where n is the number of the switches) resonance frequencies can be achieved.

The number (X) of the third transmission lines 83 provided in the first section, the number (Y) of the third transmission lines 83 provided in the second section and the number (Z) of the first transmission lines 81 provided in the second section are not limited to "X=1, Y=2 and Z=1", but they may be arbitrarily selected on condition that the conditions "X=0, 1, 2, 3, . . . ", "Y=0, 1, 2, 3, . . . ", "Z=0, 1, 2, 3, . . . " and "X+Y≧1" are satisfied.

In the resonant element 5D, the condition "X=1, Y=2 and Z=1" is not essential, but switching between $2^n$ (n is the number of the switches) resonance frequencies can be achieved if the conditions "X=0, 1, 2, 3, . . . ", "Y=0, 1, 2, 3, . . . ", "Z=0, 1, 2, 3, . . . " and "X+Y≧1" are satisfied.

In the resonant element 5D according to the fifth embodiment described in the foregoing, one end 71 of the transmission line series 7D is a ground end and the other end thereof is an open end, the transmission line 8 closest to one end 71 of the transmission line series 7D in the first section is the second transmission line 82, the third transmission line 83 is provided in at least one of the first and second sections, and the first transmission line 81 is provided at least in the first section among the first and second sections.

Therefore, switching between a plurality of (or $2^n$, where n is the number of the switches) resonance frequencies can be achieved by a simple configuration with low signal loss. In addition, since the resonant element 5D has such resonance frequencies at which the resonance length of the transmission line is equal to λ/4, the size of the resonant element 5D can be made smaller than the sizes of the resonant elements 5, 5A, 5B and 5C according to the first to fourth embodiments.

Sixth Embodiment

Next, a wireless communication apparatus 1000E according to a sixth embodiment will be described.

<Wireless Communication Apparatus>

First, the configuration of the wireless communication apparatus 1000E will be described.

The wireless communication apparatus 1000E differs from the wireless communication apparatus 1000 according to the first embodiment only in that the first filter section 12E and the second filter section 20E are provided with a high frequency filter 50E. Accordingly, only the different portions will be described, and other common portions will be denoted by the same reference signs to omit detailed description.

Figure 18:
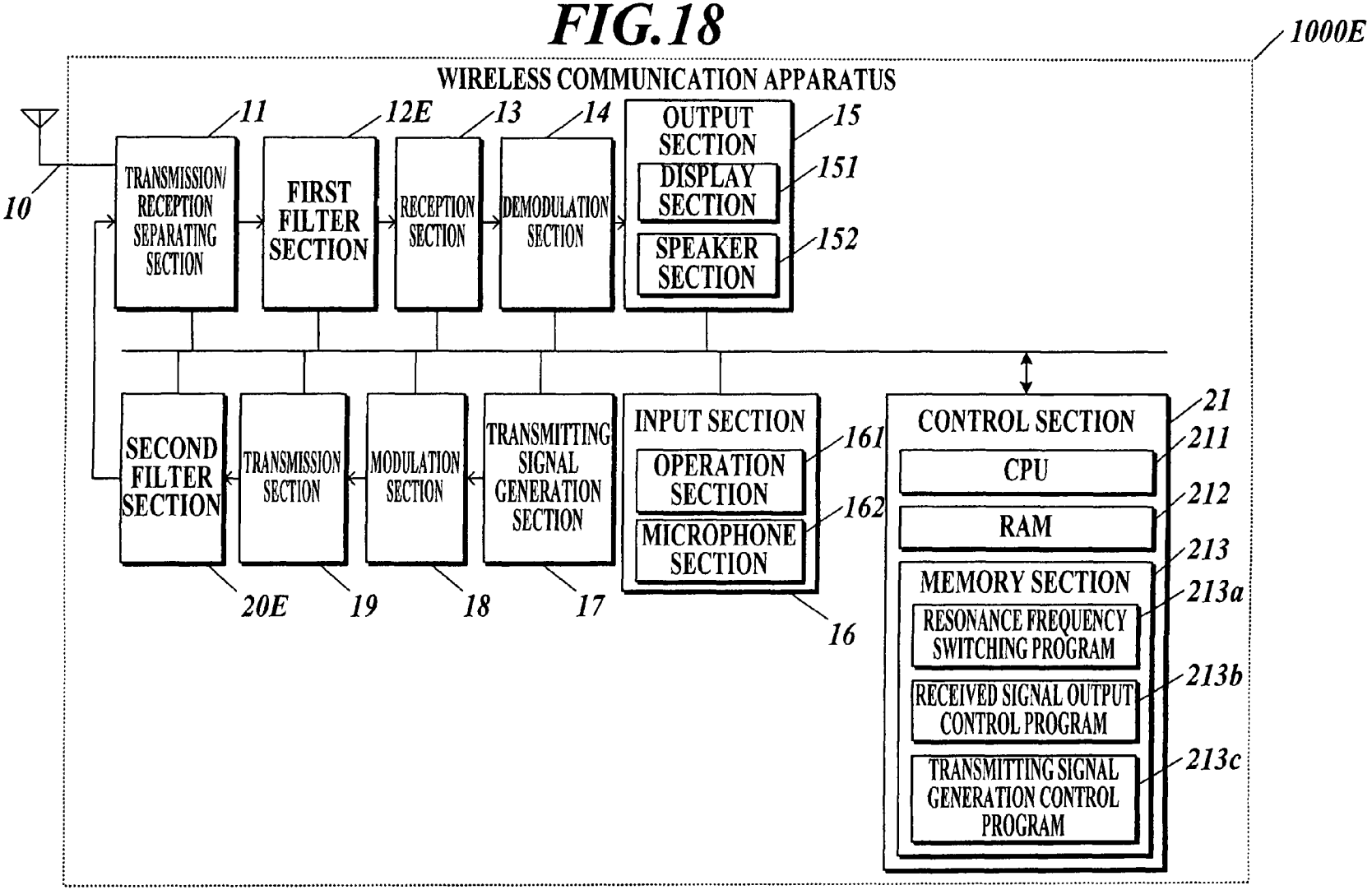
FIG. 18 is a block diagram showing the functional configuration of a wireless communication apparatus according to a sixth embodiment.

As shown in FIG. 18, for example, the wireless communication apparatus 1000 is composed of an antenna 10, a transmission/reception separating section 11, a first filter section 12E, a reception section 13, a demodulation section 14, an output section 15, an input section 16, a transmitting signal generation section 17, a modulation section 18, a transmission section 19, a second filter section 20E and a control section 21 etc.

The first filter section 12E, for example, obtains a signal located in a predetermined frequency band from a signal input from the transmission/reception separating section 11 and outputs it to the reception section 13, in response to a control signal input from the control section 21.

Figure 19:
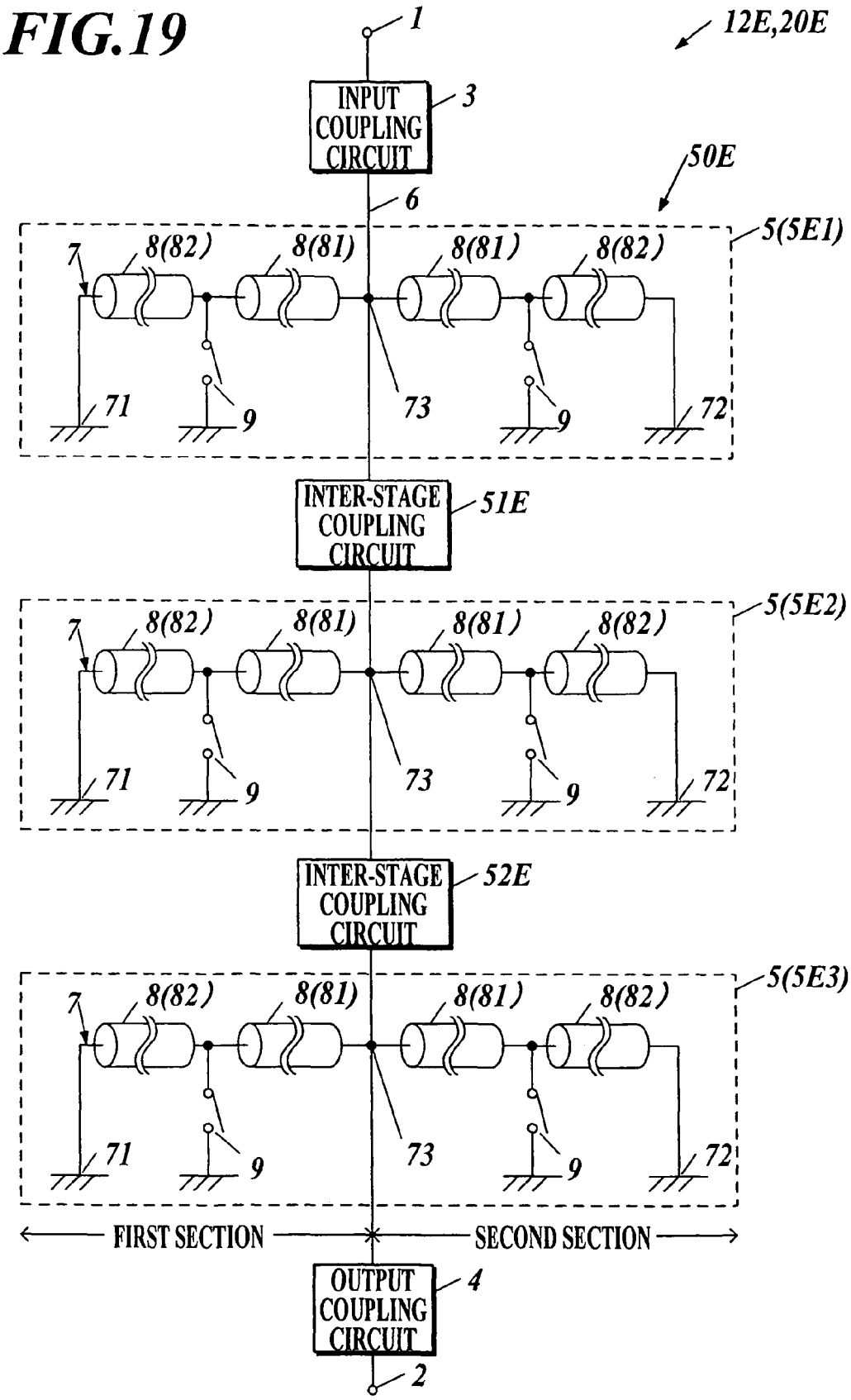
FIG. 19 is a diagram showing the configuration of a high frequency filter provided in the wireless communication apparatus according to the sixth embodiment.

Specifically, as shown in FIG. 19, for example, the first filter section 12E is composed of an input terminal 1, an input coupling circuit 3, an output coupling circuit 4, an output terminal 2, hotlines 6 and a high frequency filter 50E composed of a plurality of resonant elements 5 arranged in cascade etc.

The second filter section 20E, for example, obtains a signal located in a predetermined frequency band from a signal input from the transmission section 19 and outputs it to the transmission/reception separating section 11, in response to a control signal input from the control section 21.

Specifically, as shown in FIG. 19, for example, the second filter section 20E is composed of an input terminal 1, an input coupling circuit 3, an output coupling circuit 4, an output terminal 2, hotlines 6 and a high frequency filter 50E etc.

<High Frequency Filter>

Next, the configuration of the high frequency filter 50E will be described.

The high frequency filter 5E is a filter capable of switching the passband or the stopband and provided in the first filter section 12E and the second filter section 20E in the wireless communication apparatus 1000.

Figure 20:
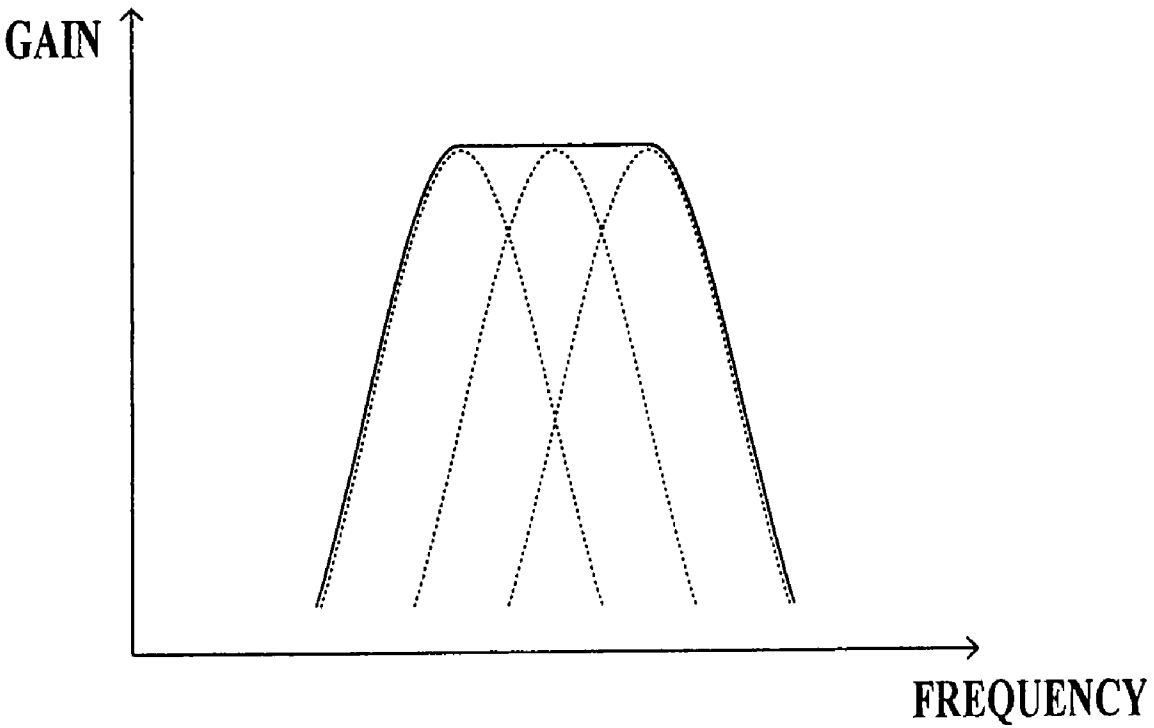
FIG. 20 is a graphical illustration of a signal output from the high frequency filter provided in the wireless communication apparatus according to the sixth embodiment.

The high frequency filter 50E causes resonance of an input signal to occur in each resonant element 5 and, as shown in FIG. 20 for example, outputs a signal (i.e. the signal indicated by solid line) resulting from superimposition of the signals (i.e. the signals indicated by broken lines) obtained in the respective resonant elements 5.

As shown in FIG. 19, for example, the high frequency filter 50E is loosely coupled with the input terminal 1 by means of the input coupling circuit 3 and also loosely coupled with the output terminal 2 by means of the output coupling circuit 4.

Specifically, the high frequency filter 50E, for example, has three resonant elements 5 (i.e. resonant element 5E1, resonant element 5E2 and resonant element 5E3), wherein, for example, the output terminal 2 side end of the hotline 6 that intersects with the transmission line series 7 of the resonant element 5E1 and the input terminal 1 side end of the hotline 6 that intersects with the transmission line series 7 of the resonant element 5E2 are connected by means of an inter-stage coupling circuit 51E, and the output terminal 2 side end of the hotline 6 that intersects with the transmission line series 7 of the resonant element 5E2 and the input terminal 1 side end of the hotline 6 that intersects with the transmission line series 7 of the resonant element 5E3 are connected by means of an inter-stage coupling circuit 52E.

The inter-stage coupling circuits 51E, 52E are composed, for example, of passive elements, such as capacitors, coils, transmission lines etc. and provided for the purpose of, for example, increasing the impedance of the hotlines 6, as with the input coupling circuit 3 and the output coupling circuit 4.

The inter-stage coupling circuits 51E, 52E may be, for example, amplifiers. The inter-stage coupling circuits 51E, 52E are not necessarily required to be provided, as with the input coupling circuit 3 and the output coupling circuit 4.

The length of corresponding transmission lines 8 in the resonant elements 5E1, 5E2 and 5E3 is designed to be increased or decreased gradually from the input terminal 1 toward the output terminal 2.

Specifically, the length of the second transmission line 82 provided in the first section of the resonant element 5E1 is designed to be shorter than the length of the second transmission line 82 provided in the first section of the resonant element 5E2 a few percent, and the length of the second transmission line 82 provided in the first section of the resonant element 5E2 is designed to be shorter than the length of the second transmission line 82 provided in the first section of the resonant element 5E3 a few percent. Alternatively, the length of the second transmission line 82 provided in the first section of the resonant element 5E1 is designed to be longer than the length of the second transmission line 82 provided in the first section of the resonant element 5E2 a few percent, and the length of the second transmission line 82 provided in the first section of the resonant element 5E2 is designed to be longer than the length of the second transmission line 82 provided in the first section of the resonant element 5E3 a few percent.

Furthermore, the length of the first transmission line 81 provided in the first section of the resonant element 5E1 is designed to be shorter than the length of the first transmission line 81 provided in the first section of the resonant element 5E2 a few percent, and the length of the first transmission line 81 provided in the first section of the resonant element 5E2 is designed to be shorter than the length of the first transmission line 81 provided in the first section of the resonant element 5E3 a few percent. Alternatively, the length of the first transmission line 81 provided in the first section of the resonant element 5E1 is designed to be longer than the length of the first transmission line 81 provided in the first section of the resonant element 5E2 a few percent, and the length of the first transmission line 81 provided in the first section of the resonant element 5E2 is designed to be longer than the length of the first transmission line 81 provided in the first section of the resonant element 5E3 a few percent.

Still further, the length of the first transmission line 81 provided in the second section of the resonant element 5E1 is designed to be shorter than the length of the first transmission line 81 provided in the second section of the resonant element 5E2 a few percent, and the length of the first transmission line 81 provided in the second section of the resonant element 5E2 is designed to be shorter than the length of the first transmission line 81 provided in the second section of the resonant element 5E3 a few percent. Alternatively, the length of the first transmission line 81 provided in the second section of the resonant element 5E1 is designed to be longer than the length of the first transmission line 81 provided in the second section of the resonant element 5E2 a few percent, and the length of the first transmission line 81 provided in the second section of the resonant element 5E2 is designed to be longer than the length of the first transmission line 81 provided in the second section of the resonant element 5E3 a few percent.

Still further, the length of the second transmission line 82 provided in the second section of the resonant element 5E1 is designed to be shorter than the length of the second transmission line 82 provided in the second section of the resonant element 5E2 a few percent, and the length of the second transmission line 82 provided in the second section of the resonant element 5E2 is designed to be shorter than the length of the second transmission line 82 provided in the second section of the resonant element 5E3 a few percent. Alternatively, the length of the second transmission line 82 provided in the second section of the resonant element 5E1 is designed to be longer than the length of the second transmission line 82 provided in the second section of the resonant element 5E2 a few percent, and the length of the second transmission line 82 provided in the second section of the resonant element 5E2 is designed to be longer than the length of the second transmission line 82 provided in the second section of the resonant element 5E3 a few percent.

In addition, when executing the resonance frequency switching program 213*a*, the CPU 211 is configured to turning on/off the corresponding switches in the resonant elements 5E1, 5E2 and 5E3 simultaneously.

Specifically, when turning the switch 9 connected in series with the second transmission line 82 provided in the first section of the resonant element 5E1 on, the CPU 211 is configured to turn also the switch 9 connected in series with the second transmission line 82 provided in the first section of the resonant element 5E2 and the switch 9 connected in series with the second transmission line 82 provided in the first section of the resonant element 5E3 on simultaneously. When turning the switch 9 connected in series with the second transmission line 82 provided in the first section of the resonant element 5E1 off, the CPU 211 is configured to turn also the switch 9 connected in series with the second transmission line 82 provided in the first section of the resonant element 5E2 and the switch 9 connected in series with the second transmission line 82 provided in the first section of the resonant element 5E3 off simultaneously.

Furthermore, when turning the switch 9 connected in series with the second transmission line 82 provided in the second section of the resonant element 5E1 on, the CPU 211 is configured to turn also the switch 9 connected in series with the second transmission line 82 provided in the second section of the resonant element 5E2 and the switch 9 connected in series with the second transmission line 82 provided in the second section of the resonant element 5E3 on simultaneously. When turning the switch 9 connected in series with the second transmission line 82 provided in the second section of the resonant element 5E1 off, the CPU 211 is configured to turn also the switch 9 connected in series with the second transmission line 82 provided in the second section of the resonant element 5E2 and the switch 9 connected in series with the second transmission line 82 provided in the second section of the resonant element 5E3 off simultaneously.

The resonant elements 5E1, 5E2 and 5E3 are configured to be switchable to allow signal resonance at resonance frequencies a little different from one another.

Thus, the high frequency filter 50 having the resonant elements 5 each of which is equipped with two switches 9 allows switching between four ($=2^n$, where n is the number of the switches) passbands or stopbands.

The high frequency filter 50E with which the wireless communication apparatus 1000E according to the sixth embodiment described above is equipped is configured by connecting a plurality of resonant elements 5 in cascade.

In this connection, all the stages of the above mentioned resonant elements may be designed to have bandpass characteristics, or one or some of them may be designed to have bandstop characteristics.

Thus, switching between a plurality of (i.e. four) passbands or stopbands can be achieved by a simple configuration with low signal loss.

In the wireless communication apparatus 1000E according to the sixth embodiment, a plurality of (i.e. four) radio frequencies can be set since it is equipped with the high frequency filter 50E.

It is not essential to design the length of corresponding transmission lines 8 in the resonant elements 5E1, 5E2, 5E3 that the high frequency filter 50E has in such a way as to be increased or decreased gradually from the input terminal 1 toward the output terminal 2. In other words, some or all of corresponding transmission lines 8 in the resonant elements 5E1, 5E2, and 5E3 may have the same length.

The high frequency filter 50E may be configured by connecting two resonant elements 5 in cascade or by connecting four or more resonant elements 5 in cascade.

The high frequency filter 50E may be configured by connecting a plurality of resonant elements 5A according to the second embodiment in cascade, by connecting a plurality of resonant elements 5B according to the third embodiment in cascade, by connecting a plurality of resonant elements 5C according to the fourth embodiment in cascade, or by connecting a plurality of resonant elements 5D according to the fifth embodiment in cascade.

The present invention is not limited to the above described embodiments, but modifications may be made when appropriate without departing from the essence of the invention.

<Modification 1>

Figure 21:
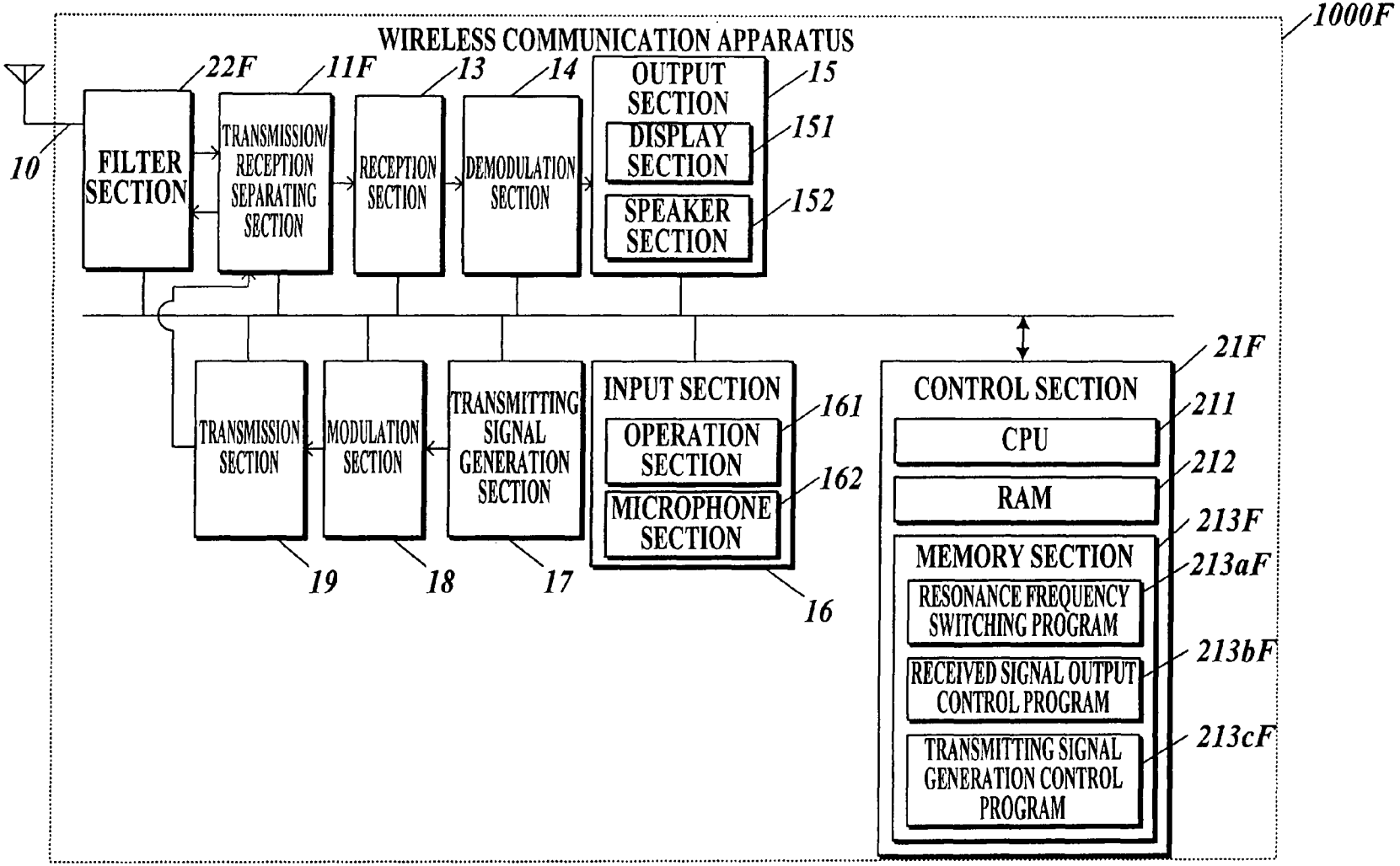
FIG. 21 is a block diagram showing the functional configuration of a wireless communication apparatus according to modification 1.

The wireless communication apparatus 1000 according to the first to fifth embodiment may be a TDD (Time Division Duplex)-capable wireless communication apparatus, such as the wireless communication apparatus 1000F shown in FIG. 21, for example, equipped with a filter section (i.e. filter section 22F) for transmission and reception.

Specifically, the wireless communication apparatus 1000F is composed, for example, of an antenna 10, a filter section 22F, a transmission/reception separating section 11F, a reception section 13, a demodulation section 14, an output section 15, an input section 16, a transmitting signal generation section 17, a modulation section 18, a transmission section 19 and control section 21F etc.

The filter section 22F, for example, obtains a signal located in a predetermined frequency band from a signal input from the antenna 10 and outputs it to the transmission/reception separating section 11F, and obtains a signal located in a predetermined frequency band from a signal input from the transmission/reception separating section 11F and outputs it to the antenna 10, in response to a control signal input from the control section 21F.

Specifically, the filter section 22F is composed, for example, of an input terminal 1 to which a signal from the antenna 10 is input and from which a signal is output to the antenna 10, an input coupling circuit 3, an output coupling circuit 4, an output terminal 2 from which a signal is output to the transmission/reception separating section 11F and to which a signal from the transmission/reception separating section 11F is input, a hotline 6 and a resonant element 5 etc.

The transmission/reception separating section 11F, for example, outputs a signal input from the filter section 22F to the reception section 13 and outputs a signal input from the transmission section 19 to the filter section 22F, in response to a control signal input from the control section 21F.

The control section 21F is composed, for example, of a CPU 211, a RAM 212 and a memory section 213F etc, as shown in FIG. 21.

As shown in FIG. 21, for example, the memory section 213F stores a resonance frequency switching program 213*a* F, a received signal output control program 213*b* F and a transmitting signal generation control program 213*c* F etc.

The resonance frequency switching program 213*a* F, for example, causes the CPU 211 to implement a function of switching the resonance frequency of the resonant element 5 provided in the filter section 22F.

Specifically, the CPU 211, for example, switches the resonance frequency of the resonant element 5 provided in the filter section 22F alternately to a resonant frequency corresponding to the reception radio frequency and a resonant frequency corresponding to the transmission radio frequency by turning on/off switches 9 in the resonant element 5 provided in the filter section 22F at predetermined timing in response to resonance frequency switching information input from the input section 16 (operation section 161).

The received signal output control program 213*b* F, for example, causes the CPU 211 to implement a function of outputting a signal (received signal) transmitted from another wireless communication apparatus and received by the antenna 10 through the output section 15 in visible and audible manners.

Specifically, for example, when the antenna 10 receives a signal transmitted from another wireless communication apparatus, the CPU 211 inputs control signals to the filter section 22F, the transmission/reception separating section 11F, the reception section 13, the demodulation section 14 and the output section 15 etc. to cause the received signal to be output through the output section 15 in visible and audible manners.

The transmitting signal generation control program 213*c* F, for example, causes the CPU 211 to implement a function of causing the transmitting signal generation section 17 to generates a signal (transmitted signal) to be transmitted to another wireless communication apparatus and causes the signal to be transmitted from the antenna 10 to the aforementioned other wireless communication apparatus.

Specifically, for example, when communication content information is input from the input section 16, the CPU 211 inputs a control signal to the transmitting signal generation section 17 to cause it to generate a signal corresponding to the communication content information and inputs control signals to the modulation section 18, transmission section 19, the transmission/reception separating section 11F and the filter section 22F etc. to cause the generated signal to be transmitted from the antenna 10 to the aforementioned other wireless communication apparatus.

Since the wireless communication apparatus 1000F according to modification 1 is equipped with only one filter section, it can be made smaller in size than the wireless communication apparatuses 1000 according to the first to fifth embodiments, which are equipped with two filter sections.

The wireless communication apparatus 1000E according to the sixth embodiment may also be modified to be a TDD-capable wireless communication apparatus equipped with a filter section for transmission and reception in a similar manner.

In the first to sixth embodiments and modification 1, the switches 9 need not to be MEMS switches.

In the first to sixth embodiments and modification 1, the wireless communication apparatus 1000, 1000E, 1000F may be an arbitrary apparatus that can communicate with another wireless communication apparatus wirelessly. For example, the wireless communication apparatus may be a PDA (Personal Digital Assistant) or a base station.

The resonant elements 5, 5A, 5B, 5C, 5D according to the first to fifth embodiments may be used in apparatuses other than the wireless communication apparatus 1000, but need not be used in the wireless communication apparatus 1000 or other apparatuses.

Similarly, the high frequency filter 50E according to the sixth embodiment may be used in apparatuses other than the wireless communication apparatus 1000, but need not be used in the wireless communication apparatus 1000E or other apparatuses.

According to the present invention, since the resonant element has switchable resonance frequencies as many as the number of combinations of the statuses of the switches (i.e. $2^n$, where n is the number of the switches) and the number of the switches is minimum for the number of the switchable resonance frequencies, signal loss can be made small.

Furthermore, the resonant element has a simple configuration which includes only transmission lines and switches, and switching between a plurality of resonance frequencies can be achieved by one resonant element, or switching between a plurality of passbands or stopbands can be achieved by one high frequency filter having a plurality of resonant elements. In addition, the number of the switches is minimum. Therefore, an increase in the size of the circuit and an increase in the number of parts can be prevented.

Thus, switching between a plurality of (or $2^n$, where n is the number of the switches) resonance frequencies or passbands (or stopbands) can be achieved by a simple configuration with low signal loss.

Although various embodiments have been described in the foregoing, the present invention is not limited to these embodiments, but the scope of the invention is intended to be defined only by the appended claims.

What is claimed is:

1. A resonant element that causes a signal input from an input terminal to resonate at a predetermined resonance frequency and outputs the signal to an output terminal, comprising:

a transmission line series that includes a plurality of transmission lines connected in series with each other and intersects with a hotline that connects the input terminal and the output terminal; and a plurality of switches, wherein at least one of one end and an other end of said transmission line series is a grounded end, the transmission lines are categorized into first transmission lines, each of which is a transmission line having a fixed length, second transmission lines, each of which is connected in series to one of the first transmission lines, and a third transmission line, which is connected in series to one of the first transmission lines and one of the second transmission lines, the plurality of switches include a switch having a grounded end and another end that is connected to a point between the first transmission lines and the second transmission lines, and a switch that is connected in parallel to the third transmission line, one of the second transmission lines is provided in the one end side of said transmission line series in a first section extending from an intersection point of said transmission line series and the hotline to the one end of the transmission line series and another of the second transmission lines is provided in the other end side of said transmission line series in a second section extending from the intersection point to other end of the transmission line series, the third transmission line is provided in at least one of the first section and the second section, the first transmission line is provided in the first section and the second section, and the resonance frequency is switched by turning on/off said switches to change the sum of the lengths of all of the transmission lines through which the signal passes.

2. A resonant element as recited in claim 1, wherein said switches are MEMS (Micro Electro Mechanical Systems) switches.

3. A high frequency filter comprising a plurality of resonant elements as recited in claim 1 that are connected in cascade.

4. A wireless communication apparatus equipped with a high frequency filter as recited in claim 3.

5. A wireless communication apparatus equipped with a resonant element as recited in claim 1.

6. A resonant element that causes a signal input from an input terminal to resonate at a predetermined resonance frequency and outputs the signal to an output terminal, comprising:

a transmission line series that includes a plurality of transmission lines connected in series with each other and intersects with a hotline that connects the input terminal and the output terminal; and a plurality of switches, wherein one end of said transmission line series is a grounded end and an other end is an open end, the transmission lines are categorized into first transmission lines, each of which is a transmission line having a fixed length, second transmission lines, each of which is connected in series to one of the first transmission lines, and a third transmission line, which is connected in series to the first transmission lines and one of the second transmission lines, the plurality of switches include a switch having a grounded end and another end that is connected to a point between the first transmission line and the second transmission line, and a switch that is connected in parallel to the third transmission line, one of the second transmission lines is provided in the one end side of said transmission line series in a first section extending from an intersection point of said transmission line series and the hotline to the one end of the transmission line series, the third transmission line is provided in at least one of the first section and a second section extending from the intersection point to the other end of said transmission line series, the first transmission line is provided in at least the first section among the first section and the second section, and the resonance frequency is switched by turning on/off said switches to change the sum of the lengths of all of the transmission lines through which the signal passes.

7. A resonant element as recited in claim 6, wherein said switches are MEMS (Micro Electro Mechanical Systems) switches.

8. A high frequency filter comprising a plurality of resonant elements as recited in claim 6 that are connected in cascade.

9. A wireless communication apparatus equipped with a high frequency filter as recited in claim 8.

10. A wireless communication apparatus equipped with a resonant element as recited in claim 6.

* * * * *